US010843252B2

(12) United States Patent
Woidasky

(10) Patent No.: US 10,843,252 B2
(45) Date of Patent: Nov. 24, 2020

(54) METAL SHEET STORAGE DEVICE AND METAL SHEET PROCESSING DEVICE COMPRISING A METAL SHEET PROCESSING MACHINE AND A METAL SHEET STORAGE DEVICE OF THIS TYPE

(71) Applicant: Bystronic Laser AG, Niederönz (CH)

(72) Inventor: Lars Woidasky, Gotha (DE)

(73) Assignee: BYSTRONIC LASER AG, Niederönz (CH)

( * ) Notice: Subject to any disclaimer, the term of this patent is extended or adjusted under 35 U.S.C. 154(b) by 62 days.

(21) Appl. No.: 15/763,762

(22) PCT Filed: Sep. 28, 2016

(86) PCT No.: PCT/IB2016/001373

§ 371 (c)(1),
(2) Date: Mar. 27, 2018

(87) PCT Pub. No.: WO2017/055903

PCT Pub. Date: Apr. 6, 2017

(65) Prior Publication Data

US 2019/0047036 A1 Feb. 14, 2019

(30) Foreign Application Priority Data

Sep. 28, 2015 (DE) ..... 20 2015 006 726 U

(51) Int. Cl.
*B21D 43/20* (2006.01)
*B21D 5/00* (2006.01)
(Continued)

(52) U.S. Cl.
CPC ..... *B21D 43/20* (2013.01); *B21D 5/002* (2013.01); *B21D 43/003* (2013.01); *B21D 43/26* (2013.01)

(58) Field of Classification Search
CPC ..... B21D 43/20; B21D 43/26; B21D 5/002; B21D 43/003; B65H 1/08
(Continued)

(56) References Cited

U.S. PATENT DOCUMENTS 3,257,015 A * 6/1966 Annable ..... B65G 57/22 414/802
3,295,660 A * 1/1967 Nelson ..... B65G 47/80 198/414
(Continued)

FOREIGN PATENT DOCUMENTS

DE 102008020349 10/2008
JP S5896828 7/1983
JP H10167411 6/1998

OTHER PUBLICATIONS

English translation of International Search Report dated Feb. 21, 2017.

*Primary Examiner* — Lynn E Schwenning
(74) *Attorney, Agent, or Firm* — Workman Nydegger

(57) ABSTRACT

The invention relates to a metal sheet storage device (21) with a housing (22), having a housing upper face (23), and with two support devices, each of which has a support plane (35, 45) for supporting metal sheets (17) or bending parts (19). The support planes (35, 45) of the support devices can be moved relative to the housing upper face (23) of the housing (22) of the metal sheet storage device (21). The invention further comprises a bending device with a bending press and such a metal sheet storage device (21).

25 Claims, 7 Drawing Sheets

Figure 1:
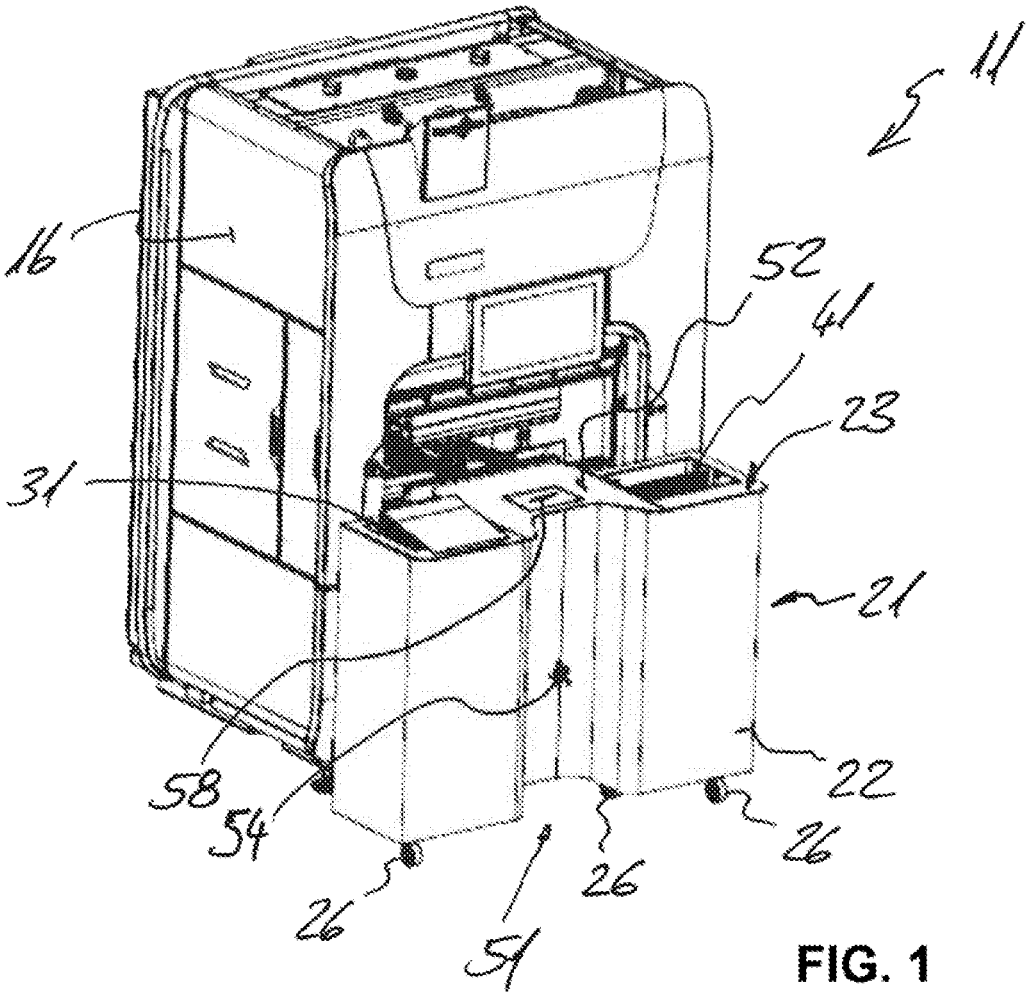

(51) Int. Cl.
*B21D 43/00* (2006.01)
*B21D 43/26* (2006.01)

(58) Field of Classification Search
USPC ..... 414/796.5; 72/405.8, 424
See application file for complete search history.

(56) References Cited

U.S. PATENT DOCUMENTS 4,195,959 A * 4/1980 Schmitt ..... B65G 57/245 414/788.9
4,802,567 A * 2/1989 Ikeda ..... B21D 43/003 198/345.1
4,860,879 A * 8/1989 Harsch ..... B21D 43/24 198/395
4,919,028 A * 4/1990 Tobita ..... B21D 43/003 269/228
5,182,936 A * 2/1993 Sartorio ..... B21D 5/0281 72/420
5,441,709 A * 8/1995 Berry, Jr. ..... A61L 2/06 422/297
5,882,174 A * 3/1999 Woerner ..... B65G 60/00 414/788.7
5,932,065 A * 8/1999 Mitchell ..... H05K 3/3415 156/382
5,984,293 A * 11/1999 Abrahamson ..... B23Q 1/035 269/236
6,298,587 B1 * 10/2001 Vollom ..... G01B 5/207 33/514.2
6,311,826 B1 * 11/2001 Tischler ..... B21C 51/00 198/395
6,386,534 B1 * 5/2002 Woody ..... B65H 31/10 271/213
6,524,052 B1 * 2/2003 Yamauchi ..... H05K 13/0434 414/331.1
7,213,684 B2 * 5/2007 Bruns ..... B66F 9/18 187/237
2009/0126187 A1 * 5/2009 Kajiyama ..... B23Q 1/035 29/760
2012/0308359 A1 12/2012 Morishima
2015/0008633 A1 * 1/2015 Chan ..... B21D 43/003 269/287
2015/0165508 A1 * 6/2015 Ichioka ..... B21D 43/24 414/222.01
2016/0151820 A1 * 6/2016 Woidasky ..... B21D 5/0272 72/20.2

* cited by examiner

METAL SHEET STORAGE DEVICE AND METAL SHEET PROCESSING DEVICE COMPRISING A METAL SHEET PROCESSING MACHINE AND A METAL SHEET STORAGE DEVICE OF THIS TYPE

The invention relates to a metal sheet storage device according to claim 1, as well as a metal sheet processing device—in particular, a bending device according to claim 26.

The processing of metal sheets using bending presses, which are also called press brakes or bending machines, is traditionally hardly automated.

The operator manually feeds in the metal sheets to be processed and deposits the processed bending part (workpiece) himself. The operator generally uses in-house storage devices, such as lifting carts, pallets, crates, etc., as metal sheet storage devices. This storage device with the prepared metal sheets is placed in front of the bending press. Each metal sheet must now be removed by the operator and positioned in front of or on the bending press. In doing so, the removal height of the stack of the metal sheets to be processed decreases continually.

The known solution is disadvantageous in that the handling of the metal sheets and of the bending parts is laborious and strenuous for the operator. In order to remove the metal sheets or the bending parts, the operator must therefore stoop more and more from bending process to bending process, which does not allow for him to work ergonomically. This known course of action, moreover, can neither be integrated into a process chain nor automated optimally. Depending upon the type of in-house storage device used, the storage device furthermore constitutes a risk of stumbling for the operator and other employees.

In the case of laser cutting machines and water-jet cutting machines, similar problems—if not the same problems—occur with metal sheets and metal sheet parts of small dimensions.

The aim of the present invention is thus to provide a metal sheet storage device and a metal sheet processing device—in particular, a bending device—which does not have the aforementioned disadvantages, and, in particular, allows for a higher degree of automation than before and offers additional advantages—in particular, for working ergonomically—to the operator.

The aim is achieved by the features of the independent claims. Advantageous developments are shown in the figures and in the dependent claims.

According to the invention, a metal sheet storage device has a housing, which has a housing upper face, and at least one support device for supporting metal sheets or bending parts, wherein the at least one support device has at least one support plane, wherein at least the at least one support plane can be moved relative to the housing upper face of the housing of the metal sheet storage device.

Such a metal sheet storage device can ensure ergonomic work. Metal sheets (unfinished parts) or metal sheet parts (semi-finished products) can always be provided at a removal height that is optimal for the operator. Bending parts (finished parts or semi-finished products) produced can also be deposited in such a metal sheet storage device at a depositing height that is optimal for the operator. In addition to a metal sheet or a metal sheet part, unfinished parts and/or semi-finished products and/or other kinds of workpieces made of metal and/or of other materials can also be provided, by means of the metal sheet storage device, to the operator of the processing machine for removal or depositing. The removal height and/or the depositing height are advantageously kept constant at a height previously defined, for example, wherein this height can furthermore be advantageously adjusted to the respective operator.

The at least one support device is advantageously arranged in the housing of the metal sheet storage device, whereby the metal sheet storage device can be designed to be compact.

The metal sheet storage device according to the invention constitutes an independent, advantageously mobile system, wherein the metal sheet storage device can, for example, be arranged in a frontal area of a metal sheet processing machine, such as a bending press, a laser cutting machine, and/or a water-jet cutting machine, and can, where appropriate, be fixed thereto by means of fasteners.

Advantageously, the fasteners are designed to be standard connections, and various metal sheet processing machines have mating connections adapted to these fasteners so that a metal sheet storage device can be arranged on various metal sheet processing machines, which may also be designed for different processing methods.

As a result of the defined removal height and/or the defined depositing height, the metal sheet storage device according to the invention also allows for easier metal sheet processing automation, since a defined removal position or depositing position is respectively given.

The size of the at least one support plane of the at least one support device is defined by the maximum surface to be occupied by the largest deposited metal sheets and/or bending parts. The design—in particular, the shape—of the at least one support plane of the at least one support device is advantageously adapted to the design of the deposited metal sheets and/or bending parts.

The metal sheet storage device according to the invention can be used as a separate work unit. Particularly in metal sheet processing, there are countless work steps, in which metal sheets or metal sheet parts must be removed, processed, and deposited again. In all these work steps, the metal sheet storage device according to the invention ensures easy handling of the metal sheets or the metal sheet parts and, in particular, allows for the operator to work ergonomically.

The at least one support device preferably has a guide, by means of which at least the at least one support plane is guided, whereby canting or tipping of the at least one support plane or the at least one support device during movement of the same is avoided. The at least one support plane or the at least one support device is, advantageously, guided vertically, whereby an unintentional sliding of metal sheets and/or bending parts deposited on the at least one support plane is easily prevented.

At least one adjusting device for adjusting the at least one support device and/or the at least one support plane is preferably provided, so that the position of the at least one support device and/or the at least one support plane can be adjusted relative to the housing upper face of the housing of the metal sheet storage device.

The height of the metal sheet stack is defined by the number of metal sheets or metal sheet parts and their thickness, as well as by the required removal height—also called provisioning height. In case of the fed in metal sheets or bending parts, the removal height continually decreases from metal sheet or bending part to metal sheet or bending part. Since the removal height is mostly constant for a bending part type or for an operator, an adjustment of the height of the at least one support plane is necessary, which can easily be carried out using the at least one adjusting device. When depositing the bent bending parts, the depositing height continually increases from bending part to bending part. By means of the at least one adjusting device, the at least one support plane can be positioned accordingly, relative to the housing upper face of the housing of the metal sheet storage device, so that the depositing height is always located at the optimal height for the operator. A metal sheet storage device with at least one adjusting device thus ensures particularly advantageous ergonomic work for the operator.

The initial height of the at least one support plane relative to the housing upper face of the housing of the metal sheet storage device is adjusted in accordance with the number, thickness, or design of the metal sheets and/or metal sheet parts and repositioned accordingly by the at least one adjusting device. The at least one support plane is advantageously repositioned continually by the at least one adjusting device. In the case of flat metal sheets, for example, the feed per metal sheet corresponds exactly to its thickness.

The at least one adjusting device can be operated or controlled manually or automatically and can be designed as a machine axis with typical, e.g., electromechanical or hydraulic, drives.

The at least one adjusting device can moreover comprise, for example, motorized actuators, one or more spring arrangements (e.g., adjustable gas springs), as well as hydraulic, electromotive, or pneumatic devices. In the case of spring arrangements, a stop is advantageously provided in order to limit the maximum displacement of the at least one support plane or the at least one support device—in particular, in the spring-loading direction.

The at least one support device preferably comprises several support elements, wherein partial support surfaces, that together form the at least one support plane of the at least one support device, are provided on the free ends of the support elements. This allows for a simple structural design of the at least one support device.

The partial support surfaces can advantageously be moved relative to each other, whereby the support elements not loaded with metal sheets or metal sheet parts serve as a guide—in particular, as a lateral guide—for the stacked metal sheets or metal sheet parts.

These support elements are advantageously designed to be tubular or rod-shaped, which further simplifies the structural design of the at least one support device.

The support elements are, moreover, advantageously arranged in parallel to each other, whereby a simple structural design of the at least one support device is also made possible.

At least several of the support elements are, respectively, preferably designed to be multi-part, whereby a simple construction of the at least one support device is made possible—in particular, in a design with partial support surfaces that can be moved relative to each other.

Each of the support elements of the at least one support device is advantageously designed to be multi-part, whereby the highest possible level of flexibility in the positioning of the metal sheets and metal sheet parts on the support surface formed by the several partial support surfaces is given.

The partial support elements of a support element are, moreover, advantageously designed to be telescope-like, so that they are easily guided on each other when one of the partial support elements is moved toward the other partial support element.

Instead of directly depositing the metal sheets and metal sheet parts on the at least one support plane of the at least one support device, they can also be positioned in a receptacle, e.g., in a box, on the at least one support plane. If the support device comprises several support elements, such a receptacle is guided by the support elements, not loaded by it.

The at least one support device preferably comprises at least one support plate, wherein the at least one support plane is formed by at least one of the surfaces of the at least one support plate. By means of the at least one support plate, the at least one support plane for the metal sheets and metal sheet parts in a metal sheet storage device can easily be provided. Moreover, the guide of the at least one support plate can be designed simply. The at least one support plate is advantageously guided vertically, whereby an unintentional sliding-off of the metal sheets and/or bending parts deposited on the at least one support plane of the at least one support plate is easily prevented.

The size of the at least one support plate is defined by the maximum surface to be occupied by the largest deposited metal sheets and/or bending parts. The design—in particular, the shape—of the at least one support plate is advantageously adapted to the design of the deposited metal sheets and/or bending parts.

Force is preferably applied to the at least one support device and/or at least a part thereof by means of at least one force device, whereby the metal sheets or metal sheet parts are provided at a constant height by utilizing potential energy. By stacking metal sheets or metal sheet parts, the at least one force device is tensioned, whereby a subjacent metal sheet or metal sheet part moves downward. When removing the metal sheets or metal sheet parts, the energy stored in the at least one force device is released again, step-by-step, so that the subjacent metal sheet or metal sheet part moves upward.

The metal sheet storage device can easily be adapted to the geometry, weight, and density of the metal sheets or metal sheet parts by means of at least one such force device. Such a solution is, moreover, free of maintenance and durable, which has an advantageous effect, in particular, on the operating costs of the metal sheet storage device.

Several force devices are particularly advantageously provided, whereby the potential energy can be stored in a more regulated manner when the metal sheets and metal sheet parts are deposited, and/or released in a more regulated manner when the metal sheets and metal sheet parts are removed.

The force of the at least one force device can, furthermore, advantageously be adjusted, whereby the storage and release of the potential energy present in the at least one force device can easily be controlled, as needed.

The at least one force device advantageously comprises at least one spring element, which allows for a simple structural design of the support device, and thus of the metal sheet storage device.

In an alternative to the at least one spring element, or supplementarily thereto, the at least one force device comprises at least one fluid-fillable container element, which supports the support device and/or at least a part thereof, and raises or lowers it as needed. Compressed air or a hydraulic liquid, which is fed to the at least one fluid-fillable container element via an appropriate feed device or discharged, is used advantageously as fluid for filling the at least one container element.

The at least one fluid-fillable container element is designed as a bellows cylinder, for example, which is, advantageously, held in a basic shape via a spring unit of the bellows cylinder. The simple structure of a bellows cylinder moreover allows for a space-saving installation in the metal sheet storage device, and thus a relatively large occupying area. As a result, a comparatively low pressure is sufficient to raise the metal sheet stack.

In case of changed conditions, the pressure in the at least one fluid-fillable container element can, accordingly, easily be adjusted by supplying or discharging fluid.

Furthermore, at least one additional spring element acting on the at least one fluid-fillable container element, or at least one counterweight relieving the at least one fluid-fillable container element, can be provided, whereby the metal sheet storage device can easily be adjusted, even when loaded with metal sheets or metal sheet parts of large dimensions and/or with heavy metal sheets or metal sheet parts.

One plane of the at least one fluid-fillable container element can, in this case, itself form the support plane of the support device that can be moved relative to the housing upper face.

When loading the at least one support device, the at least one fluid-fillable container element is, advantageously, unpressurized and is compressed, accordingly, by the weight of the metal sheets or metal sheet parts loaded. In order to remove the metal sheets or bending parts, the at least one fluid-fillable container element is loaded with fluid. Now, pressure is built up in the at least one fluid-fillable container element until the metal sheet stack moves upward in the direction of the housing upper face, and the topmost metal sheet or metal sheet part reaches the desired removal height. Now, the pressure in the at least one fluid-fillable container element is no longer increased further. The operator can start his work in an ergonomically advantageous starting position and remove the respectively topmost metal sheet or metal sheet part for further processing. As a result of the now reduced weight of the metal sheet stack, the force acting on the at least one fluid-fillable container element decreases, whereupon the at least one fluid-fillable container element again expands. This raises the metal sheet stack upwards again, and the next metal sheet or metal sheet part can be removed at the desired height.

After successful loading of the metal sheet storage device, this metal sheet storage device can, for example, be transported to a metal sheet processing machine, such as a bending press, and the at least one fluid-fillable container element can first be loaded with fluid via a fluid feed device there, for example.

The fluid feed device is, for example, integrated into the metal sheet storage device or assigned thereto. Alternatively, the fluid can also be fed via the metal sheet processing machine or a power supply unit, which is advantageously designed to be mobile.

For feeding compressed air as fluid, the fluid feed device comprises, for example, at least one compressor, which is supplied with power via a battery and/or a metal sheet processing machine, or a simple manual pump.

In one embodiment of the metal sheet storage device with several support elements designed to be multi-part, force is advantageously applied to at least one of the support elements via at least one force device, whereby a metal sheet storage device that can be used for metal sheets or metal sheet parts of various designs is provided.

The partial support elements of a support element are advantageously designed to be tubular, which allows for a simple structural design of the support elements. The partial support elements of a support element, moreover, are, advantageously, overlapping, at least region-wise, e.g., inserted into each other, whereby the partial support elements can be varied in their lengths and at the same time guided on each other in a simple structural design.

Force is applied advantageously to at least one of the partial support elements—more advantageously, to the partial support element with the partial support plane.

The at least one additional partial support element of a support element is advantageously affixed to a base plate and, advantageously, at the same time serves as a guide for at least one force device arranged thereon, such as at least one spring element. The at least one spring element is, for example, pulled over the at least one additional partial support element or arranged therein if the latter is, for example, designed to be tubular, at least region-wise. The at least one force device or the at least one spring element is supported by the base plate or the at least one additional partial support element, and the other partial support element pulled over it, for example.

At least the movable partial support element of a support element is advantageously connected to a guide plate—advantageously, to a guide plate—by means of which the pre-tensioning of the at least one force device can, particularly advantageously, be adjusted at the same time. The metal sheets or metal sheet parts are stacked on the partial support planes of the support elements. When stacking metal sheets or metal sheet parts, the guide length of the partial support elements is increased accordingly, based upon the resulting increase in overlap.

Via such an arrangement of individual force devices—and, in particular, of several individual spring elements—this embodiment of a metal sheet storage device allows for an absolutely flexible and automatic adaptation to various metal sheet contours, and thus also to various metal sheet weights.

Compared to known storage devices from technically dissimilar fields, in which individual springs must be rearranged or removed or added in order to adapt the force to various part sizes, this is not necessary in the metal sheet storage device according to the invention. As a result of the spring loading of the support plane using several individual spring elements, only the spring force actually necessary for the metal sheets or metal sheet parts is provided, according to the contour and weight of these metal sheets or metal sheet parts. The spring elements are selected according to the density of the material to be used—for example, made of steel or aluminum.

Advantageously, at least one attachment element is provided, whereby the at least one support plane, independently of its design, can easily be adapted to a given contour of a metal sheet or a bending part. For example, the at least one attachment element is designed as a negative form of the metal sheets or bending parts, and thus to be specific to the workpiece, which proves to be particularly advantageous in the case of large quantities. The at least one attachment element can advantageously be adjusted geometrically, whereby frequently-changing metal sheet contours or bending part contours can be placed quickly and economically onto the at least one support plane or be fixed and stacked thereon, where appropriate.

The at least one attachment element is advantageously fixed on the at least one support plane at a particularly advantageously adjustable angle in accordance with the principle of the inclined plane, in order to cause the stacked metal sheets or bending parts to slide, for example. For this purpose, the inclination of the at least one attachment element is adjusted in accordance with the ratio of the downhill force to the static frictional force. In this way, the stacked metal sheets or bending parts slide against a stop side or stop surface, for example, which is located inside the metal sheet storage device, for example, and are held there.

Such a stop side or stop surface advantageously extends to a transfer point, where the metal sheet or bending part is delivered to the operator. For example, on the metal sheet storage device, an appropriate opening is provided, through which the metal sheet or the bending part of the stack can be removed or slide out. The stop side or stop surface advantageously faces the operator so that the metal sheet or the bending part can be delivered to the operator directly. Additionally or alternatively, an adjustable stop or a slip-resistant surface can be provided, in order to fix the metal sheet or the metal sheet part or provide it to the operator in an operator-friendly position.

The at least one attachment element can advantageously be arranged as needed at or on the at least one height-adjustable support plane. If the at least one support plane is formed by the surface of at least one support plate, the at least one attachment element can, for example, be fixed on the at least one support plate in a pluggable manner, wherein the at least one support plate then advantageously has corresponding plug receptacles, at least region-wise. The at least one support plate may, for example, at least region-wise, have a perforated plate structure with an advantageously uniform hole pattern. Alternatively, the at least one attachment element is designed to be able to be clamped or otherwise mechanically connected to the at least one support plate. Another variant is, for example, an attachment element that can be connected to the at least one support plate in a magnetic or temporarily adhering manner.

At least one separation device for separating the metal sheets or metal sheet parts is preferably provided, whereby efficient processing of bending plans is ensured. In particular, greased metal sheets or metal sheet parts additionally make handling more difficult, since they partially stick together and must be tediously separated by hand. By means of the at least one separation device, such metal sheets or metal sheet parts can also be easily separated.

The at least one separation device comprises, for example, a moving device, which is, for example, arranged above the metal sheet or metal sheet part to be separated. Such a moving device has, for example, a linear guide with a stop attached thereto. This stop is advantageously adapted or adaptable to the thickness of the metal sheet or the metal sheet part. The operator moves the stop along the linear guide, wherein this stop, for example, touches the back edge of the topmost metal sheet or metal sheet part and separates this metal sheet or metal sheet part from the stack during further movement. This separation process may, where appropriate, be automated.

Another non-exhaustive variant for providing and separating the topmost metal sheet or metal sheet part from a stack can be the use of fanning magnets. In this case, the topmost metal sheet or metal sheet part pushes away from the subjacent metal sheet or metal sheet part as a result of using two homopolar magnets, and can then be easily removed by the operator. This separation variant is particularly advantageous in the case of greased and strongly sticking metal sheets or bending parts.

Instead of manually operating the at least one separation device, it can also be designed for semi-automatic or fully automatic operation—advantageously, be motor-driven.

The at least one separation device is, advantageously, arranged on the metal sheet storage device or on the at least one support device so as to swing out of the way, whereby a metal sheet or metal sheet part can easily be deposited or removed without using the at least one separation device.

A work area section is preferably provided with a metal sheet storage device support plane, which serves as a metal sheet support or feed table. A metal sheet or metal sheet part guided upwards is provided to the operator on one side of the work area section, for example, and the metal sheet storage device support plane serves the operator as a work area or shelf.

In an advantageous variant thereto, a metal sheet or metal sheet part guided upwards is provided to the operator on one side of the work area section, for example, while the finished bending parts are deposited and stored on the opposite side. The metal sheet storage device support plane is thus located between these sides and forms an intermediate zone as a work area for the operator.

The metal sheet storage device support plane is advantageously located on the same plane as the housing upper face of the housing of the metal sheet storage device, so that a metal sheet or a metal sheet part can be moved in the same plane, and easy handling of the same is thus ensured.

Advantageously, at least one area—and, in particular, the entire area—of the metal sheet storage device support plane, on which a metal sheet or metal sheet part comes to rest during the processing step, is designed as a fluid store—in particular, as a gas store, and, advantageously, as an air store. For example, a fluid—preferably, gas and/or air—exits from appropriate openings in this area of the metal sheet storage device support plane. As a result, the metal sheets or metal sheet parts are protected from scratches when they are moved across the metal sheet storage device support plane. In consequence of the resulting reduced friction between the metal sheets or metal sheet parts and the metal sheet storage device support plan, the work of the operator is, in addition, made easier.

In order to create a gas store, the metal sheet storage device can have a corresponding store. Additionally or alternatively, the metal sheet storage device comprises a compressor, which is, advantageously, integrated into the metal sheet storage device. Such a compressor is supplied with power by a power supply outside of or integrated into the metal sheet storage device, for example.

At least one conveyor for conveying the metal sheets and/or metal sheet parts is preferably provided in, on, or near the metal sheet storage device support plane, whereby the turning and feeding of the metal sheets and/or metal sheet parts is substantially facilitated—especially for the operator. By means of the at least one conveyor, work steps can even be omitted, whereby the operation is facilitated and/or automation or partial automation is simplified.

The at least one conveyor comprises, for example, a sliding surface or several sliding surfaces, wherein the latter can be provided with a sliding layer in the form of a coating or a film, for example. The at least one conveyor may also or alternatively comprise a roller or several rollers and/or a conveyor belt or several conveyor belts.

A rotary table device or a rotary table may also be provided as at least one conveyor of the metal sheet storage device or as a separate device that can advantageously be coupled to the metal sheet storage device. The rotary table receives metal sheets and/or metal sheet parts and conveys them to the operator or the bending press for processing, and/or to additional storage areas or conveyors.

A sensor device for detecting a metal sheet or metal sheet part located on the rotary table is, advantageously, provided. If a metal sheet or bending part placed on the rotary table is detected, the rotary table is, for example, put into rotation, and the metal sheet or bending part is conveyed to the previously defined position. The rotary table is, for example, driven electromotively, hydraulically, pneumatically, or manually.

Metal sheet part collecting devices for the bent bending parts are advantageously provided, which are arranged on and/or near the metal sheet storage device so as to be advantageously removable. Such metal sheet part collecting devices comprise bags or boxes, for example, which are respectively made of plastic, paper, or cardboard, for example, wherein this list is not exhaustive.

The metal sheet storage device support plane preferably has, at least region-wise, a transparent region, which provides a view for the operator. The transparent region is, for example, formed by a glass or plastic. The transparent region is, for example, back-lit by a suitable illuminant, so that metal sheet parts arranged on the transparent region can easily be checked by the operator as to their correct design, for example.

A display for displaying information is preferably provided. The display is advantageously arranged behind the transparent region of the metal sheet storage device support plane so that the display is protected against soiling and wear by the transparent region. In this case, the display comes to rest directly in the field of vision of the operator. Alternatively, the display is embedded directly into the metal sheet storage device support plane and forms a part of the metal sheet storage device support plane.

This display shows useful information, for example, and can additionally serve as operator guidance for the operator. For example, the display

- shows the parts yet to be produced;
- displays the next batch;
- visualizes a current direction of rotation of the metal sheet;
- shows a current bending angle, as well as its correctness, where appropriate, (this can also be shown in connection with an angle measuring device);
- indicates the retooling of the bending press, e.g., the type, number, and position of the tools;
- illustrates the bending press control;
- shows information that can relate to the internal company workflow, such as the receipt of an urgent order, the immediate stopping and modification of the machine, etc., communication with other production centers, etc.;
- shows maintenance intervals or faults of the bending press or the metal sheet dispensing device;
- shows the storage position of the completed order within the company to the operator, wherein the aforementioned list is not exhaustive.

The display has a touch-sensitive surface (touchscreen, etc.), for example, so that commands can be transferred from the display directly to the control of the bending press, of the metal sheet storage device, or to another communication.

Information can, alternatively, also be visualized via a projection (e.g., a laser projection) onto the metal sheet storage device support plane, for example.

The metal sheet storage device advantageously comprises at least one fill-level display device, which allows suitable measures to be taken—advantageously, automatically—based upon the detected information. For example, for re-ordering metal sheets or metal sheet parts, if these fall below a certain quantity. Information for picking up the bent bending parts can, moreover, also be generated, if enough bending parts are available.

The at least one fill-level display device advantageously has an interface to the metal sheet processing device, to the metal sheet processing machine, and/or to an in-house or external IT system, whereby the information captured by the at least one fill-level display device can easily be supplied to the respective system and processed therein.

The at least one fill-level display device can, for example, be realized via conventional sensors. Supplementarily or alternatively, the weights of the metal sheets or the metal sheet parts can also be checked and compared for this purpose.

If the number of metal sheets or metal sheet parts falls below a certain quantity or if a certain number of bent metal sheet parts is exceeded, an acoustically and/or visually perceivable signal is advantageously triggered, whereby this state is easily recognizable by the operator.

At least one opening is advantageously provided for the operator on the metal sheet storage device, whereby the operator can get as close to the metal sheet storage device as needed, and work ergonomically as a result. The at least one opening may be provided in a vertical plane or in a horizontal plane on the metal sheet storage device. Several openings may, moreover, be arranged in vertical as well as horizontal planes. The geometric shape of the metal sheet storage device is advantageously adapted to ergonomic aspects by means of the at least one opening and allows for efficient use of the metal sheet processing machine—in particular, the bending press. From the viewpoint of ergonomics, the at least one opening is particularly advantageously provided in the area of the metal sheet storage device support.

At least one post-processing device for post-processing the metal sheets and/or bending parts is preferably provided, whereby bending parts produced are protected and/or processed. Some bending parts—in particular, those having a sensitive surface—must be protected against scratches and other damage.

For example, the at least one post-processing device comprises a film device with at least one roll of film, for example, from which the protective film can easily be cut to length and can easily be attached to the bending part. Such a film device can, for example, be mounted directly over an opening for receiving the bending parts produced. In order to cut a film section to length, a length cutting device (e.g., a knife) is advantageously provided, which can be operated manually by the operator, or which is automated. Moreover, advantageously provided is a guide for the film, which makes it possible for the operator to manually apply the film to the bending part. Particularly advantageously, the operator is provided with adjustment possibilities, which allow for an adaptation to different geometries. Such a film device moreover allows for a complete automation in applying the protective film.

The at least one post-processing device comprises a printer, for example, in order to mark the metal sheets and/or produced bending parts with, for example, labels or codes for, for example, further production. For an optimal workflow, such a printer is, advantageously, provided near an area of the metal sheet storage device support.

The at least one post-processing device comprises, for example, at least one checking device—for example, in order to check the produced bending parts. Using the at least one checking device, first quality controls can easily be performed on the produced bending part directly at the bending press and, where appropriate, documented.

The at least one post-processing device also comprises, for example, a processing unit, with which a metal sheet or a metal sheet part can be processed prior to or after the processing step—in particular, prior to the actual processing step, such as a bending or chamfering. This processing unit is designed, for example, for introducing threads, for deburring, for joining, for welding, for gluing, etc., wherein this list is not exhaustive.

The metal sheet storage device can also perform or support additional work steps on the metal sheets or metal sheet parts. The devices required for this purpose are advantageously supplied with power by a power device integrated into the metal sheet storage device. As a result, the metal sheet storage device can also serve as a separate work area, independent of the metal sheet processing machine.

For example, a "thread cutting" work area is provided. To this end, the stacked bending parts, with the work area and the now empty feed device, in reverse order, are used as an independent workstation. The bending part is located, in an ergonomically optimal manner, in the upper area, is grabbed, and is guided to the work area. There, it is, advantageously, fixed, and the thread is cut. After the work step has ended, the bending part is deposited into the empty former feed device. The "feed device" can now equally serve as a "discharge device." The process now takes place precisely in the reverse order; removing and stacking, however, also result in an optimal working height, since the height adjustment described is also achieved.

The metal sheet storage device, furthermore, advantageously has a clamping and/or holding device for fixing metal sheets and, in particular, bending parts. The fixed metal sheets or bending parts can subsequently be easily processed further.

As a result of the separate and modular use of feed area, work area, and discharge area, metal sheets can also be processed separately as unfinished parts prior to the actual processing step—in particular, prior to a bending process. For example, the stacked metal sheet stack can be deburred or measured in the work area, and deposited in the discharge area as described. During the next processing step (e.g., during bending), the discharge area is then, again, the feed area. In this case, the modular structure of the metal sheet storage device makes possible an ergonomic arrangement of these areas. The operator can then always work "from left to right," i.e., remove on the left (feed area), process in the center (work area), and deposit on the right (finished product discharge area). Working from "right to left" is also possible. The operator can arrange his own personal process by appropriately reconnecting the areas. The feed and discharge devices are thus no longer fixed mechanical assemblies, but, rather, the definition of the current process.

The metal sheet storage device advantageously has depositing devices, such as a docking station for smartphones, speakers for playing media, holders for coffee cups, holders for working papers, or general use shelves, which offer supports for the operator.

Depositing devices for measuring devices are, furthermore, advantageously provided, in which the latter can be optimally deposited and optionally stored.

The at least one post-processing device is advantageously arranged in, on, or near the metal sheet storage device support plane, whereby the latter can easily be operated by the operator. The at least one post-processing device is, furthermore, advantageously arranged so as to swivel so that it can be placed at a different location, e.g., in order to fill the metal sheet storage device with metal sheets or metal sheet parts.

One first support device for supporting metal sheets or bending parts and at least one second support device for supporting metal sheets or bending parts are preferably provided, wherein the at least one support plane of the first support device and the at least one support plane of the at least one second support device can respectively be moved relative to the housing upper face of the housing of the metal sheet storage device. The at least one first support device forms an area of metal sheet feeding, for example, and the at least one second support device forms an area of the bending part discharge of the metal sheet storage device, for example. Alternatively, more than two support devices are provided, which are designed in accordance with the bending plan or the internal process flow for feeding and/or discharging the metal sheets and/or bending parts, or which serve this purpose.

A work area section is particularly preferably provided between the first support device and the at least one second support device so that the metal sheet storage device advantageously has three zone sections on the housing upper face of the housing of the metal sheet storage device, which zone sections allow for easy and efficient work by the operator.

The at least one support plane of the first support device and the at least one support plane of the at least one second support device can preferably be moved separately from each other relative to the housing upper face of the housing of the metal sheet storage device. When removing metal sheets or bending parts, the one support plane moves in the direction relatively towards the housing upper face of the housing of the metal sheet storage device. When depositing produced bending parts, the one additional support plane moves in the direction relatively away from the housing upper face of the housing of the metal sheet storage device. The movement of the first support plane and/or of the at least one second support plane advantageously takes place in a controlled manner.

Alternatively, the at least one first support plane and the at least one second support plane are coupled to each other, whereby their positions relative to each other are directly dependent upon each other. The at least one first support plane and the at least one second support plane can advantageously be moved in opposite directions relative to the housing upper face of the housing of the metal sheet storage device, in order to feed metal sheets or bending parts to the metal sheet storage device, on the one hand, and to be able to deposit produced bending parts.

A simple coupling, which can do without particular control elements, motors, or the like, is an advantageously mechanical connection, for example, between the at least one first support plane (e.g., as metal sheet feed device or bending part feed device) and the at least one second support plane (e.g., bending part discharge device), which mechanical connection is advantageously designed as a beam balance system. The weight of the metal sheet or bending part does not change as a result of the bending work step, and thus remains constant. As a result, this solution allows for a continuous adjustment of the position of the support planes relative to the housing upper face of the housing of the metal sheet storage device, based upon the changing weights of the stacks and their heights.

The arms of the mechanical connection are advantageously hinged to the at least one first support plane or support device and the at least one second support plane or support device via a rotary joint, so that a rotatable connection is given in the connection region. The length of the exemplary mechanical connection can, furthermore, advantageously be adjusted—in particular, in the case of guided support planes or support devices. The length is advantageously adjusted automatically—in particular, in the case of guided support planes—by a suitable control or structural design, for example. The arms of the connection allow for a continuous weight and height adjustment of the at least two support planes or support devices. At the beginning of a production order, the at least one first support plane is in a lowest position, due to the high weight of the stack of the metal sheets or the bending parts to be processed. The at least one first support plane is positioned relative to the housing upper face of the housing of the metal sheet storage device such that the topmost metal sheet or bending part is located at the height of the work area. The at least one second support plane, on the other hand, is located in its highest position and therefore can also receive the bending parts produced in the bending press in an operator-friendly manner. As soon as the operator removes the topmost metal sheet or bending part, processes it at the bending press, and deposits the produced bending part on the at least one second support plane, the at least one second support plane lowers, while the at least one first support plane rises so that the next metal sheet or bending part is again available at the desired removal height. During processing of the production order, a consistent, constant working height is thus given for the operator.

A possibility of adjusting the center of rotation of the advantageously mechanical connection is, advantageously, provided, whereby the system is easily optimizable.

The system of equilibrium can, alternatively, also be achieved via, for example, a rope arrangement or a hydraulic arrangement.

At least one power supply device is preferably provided, whereby a stand-alone and mobile metal sheet storage device is created. Interfering contours and other causes of stumbling can thus be avoided, which hinder operation, for example, or entail potential risks for the operator.

The at least one power supply device comprises an energy store, for example, which is advantageously chargeable. The energy store can, for example, be charged at a power supply of the metal sheet processing machine or at a suitable storage area. A standard connection for connecting a power connection line is advantageously provided, whereby commercially available power lines can be connected. Several different, advantageously standard connections are, furthermore, advantageously provided on the metal sheet storage device in order to supply power, whereby commercially available power lines, but also power lines of different power sources, can be connected.

Preferably, at least one detection device for a metal sheet and/or a bending part is provided, wherein the type of the at least one detection device is selected according to the information to be detected.

For example, an optical unit, such as a camera, is provided as at least one detection device, in order to check the metal sheet before the bending process and/or the bending part after the bending process.

The at least one detection device can also be designed to determine the weight of the metal sheets or the bending parts, whereby the quantity can, for example, easily be checked when producing several bending parts. Alternatively, the at least one detection device is designed to determine the quantity of the metal sheets or bending parts. Such detection devices allow for signaling the operator or a device early, so that a timely supply of metal sheets or bending parts, or a timely discharge of bending parts, and thus a smooth process, even of larger production lots, are ensured.

The working height of at least a part of the metal sheet storage device can preferably be adjusted, whereby the metal sheet storage device can be adapted, at least region-wise, to changing working heights of the bending press, and an ergonomic working height is thus ensured for a plurality of operators. This adjustment process can be carried out by means of a manual device or via a controlled axis, and, for example, in a motorized or hydraulic manner.

At least one traversing unit is preferably provided for the metal sheet storage device, whereby the metal sheet storage device can easily be repositioned as needed. The at least one traversing unit comprises rollers or wheels, for example, which are advantageously arranged on the bottom side of the metal sheet storage device. For easy displacement of the metal sheet storage device, the at least one traversing unit has at least one electromechanical, pneumatic, or hydraulic drive, for example.

At least one lifting device is preferably provided for the metal sheet storage device, which allows for easy repositioning of the metal sheet storage device. For example, mounted advantageously at the center of gravity of the metal sheet storage device are loops and eyes for conveyor belts, which can, for example, be attached to the fork of a forklift truck or, for example, to a hook of a crane, as a lifting device. By means of the forklift truck and/or the lifting device, the metal sheet storage device can easily be repositioned. Compared to an alternative design with special and/or fixed fork receptacles or engagement eyes, which, in their own right, also have advantages, this solution has the additional advantages that a space-saving construction of the metal sheet storage device and a flexible adaptation to different fork sizes or hooks are possible.

As a result of the possibility of repositioning the metal sheet storage device, whether by means of at least one traversing unit and/or by means of at least one lifting device, the metal sheet storage device can also serve as storage or intermediate storage, in addition to the feeding and discharging of metal sheets or metal sheet parts. Especially when the metal sheet storage device is used as a separate (work area) module, the at least one traversing unit and/or the at least one lifting device ensures an easy possibility of repositioning the metal sheet storage device.

Preferably, at least one metal sheet stop device for stopping metal sheets or bending parts is provided, whereby the latter can easily be positioned. This at least one metal sheet stop device forms a front stop for the operator. A back stop of the bending press can be omitted. Even complex bending parts can easily be positioned for a bending process, using the at least one metal sheet stop device. This results in a saving of time during the bending process—especially for experienced operators—since the influence of the inertia of the back stop to be adjusted on the bending process is eliminated.

The at least one metal sheet stop device is advantageously provided in the area of the metal sheet storage device support plane, whereby an easy stoppage of the metal sheets or bending parts is made possible.

The at least one metal sheet stop device preferably has several fixing points and at least one stop element that can be arranged in at least one of the fixing points, whereby a desired adjustment of the front stop created by the at least one metal sheet stop device can easily be set as needed. The operator selects the stop element suitable for the bending process to be performed and fixes it on the respective fixing point or on the respective fixing points.

The fixing points are designed to receive at least one stop element or are adapted to it. For example, the fixing points are designed as holes or as depressions or as recesses, in which a projection or hold point correspondingly designed on the at least one stop element engages. In an alternative, but not final, design, the fixing points are designed as elevations, and correspondingly designed depressions or recesses are provided on the at least one stop element.

Individual fixing points can likewise be designed as holes or as depressions or as recesses, and other fixing points of the same stop device can be designed as elevations.

The at least one stop element then has correspondingly complementary designs for fixing the stop element on the fixing points. In this case, the at least one stop element need not necessarily have two types of designs of the holding parts for arranging the stop element on the fixing points. One stop element is designed, for example, to be arranged on fixing points designed as holes, and another stop element is designed to be arranged on fixing points designed as elevations.

The at least one metal sheet stop device particularly advantageously comprises a guide for metal sheets or bending parts, and/or the at least one stop element is designed for this guide or has at least one corresponding guide section for this guide. Small metal sheets or small bending parts can, in particular, be pushed in or on such a guide to the bending line. As a result, these metal sheets or bending parts need not be moved and handled individually in a cumbersome manner, whereby the bending process can be performed in a more efficient and productive manner than on traditional bending presses.

A metal sheet processing device according to the invention comprises a metal sheet processing machine and a metal sheet storage device, which has at least one of the aforementioned features. The metal sheet processing device is advantageously a bending device, which comprises a bending press or a press brake or bending machine, as well as such a metal sheet storage device. Additional types of suitable metal sheet processing machines for a metal sheet processing device are, for example, laser cutting machines and/or water-jet cutting machines, but also thread cutting devices, clinch presses, deburring devices, and/or the like.

Such a metal sheet processing device according to the invention—in particular, such a bending device—is characterized by a high efficiency, while ensuring ergonomic work conditions for the operator of the metal sheet processing device.

Additional advantages, features, and details of the invention result from the following description, in which exemplary embodiments of the invention are described with reference to the drawings.

The list of reference symbols, as well as the technical content of the claims and figures, are part of the disclosure. The figures are described coherently and comprehensively. The same reference symbols refer to the same components; reference symbols with different indices indicate components with the same function or similar components.

Figure 2:
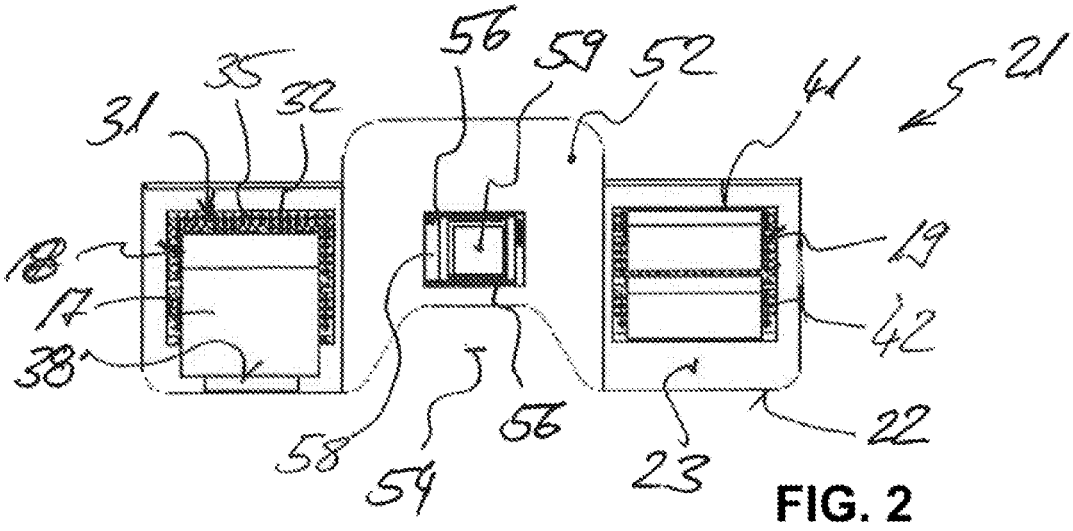
Figure 3:
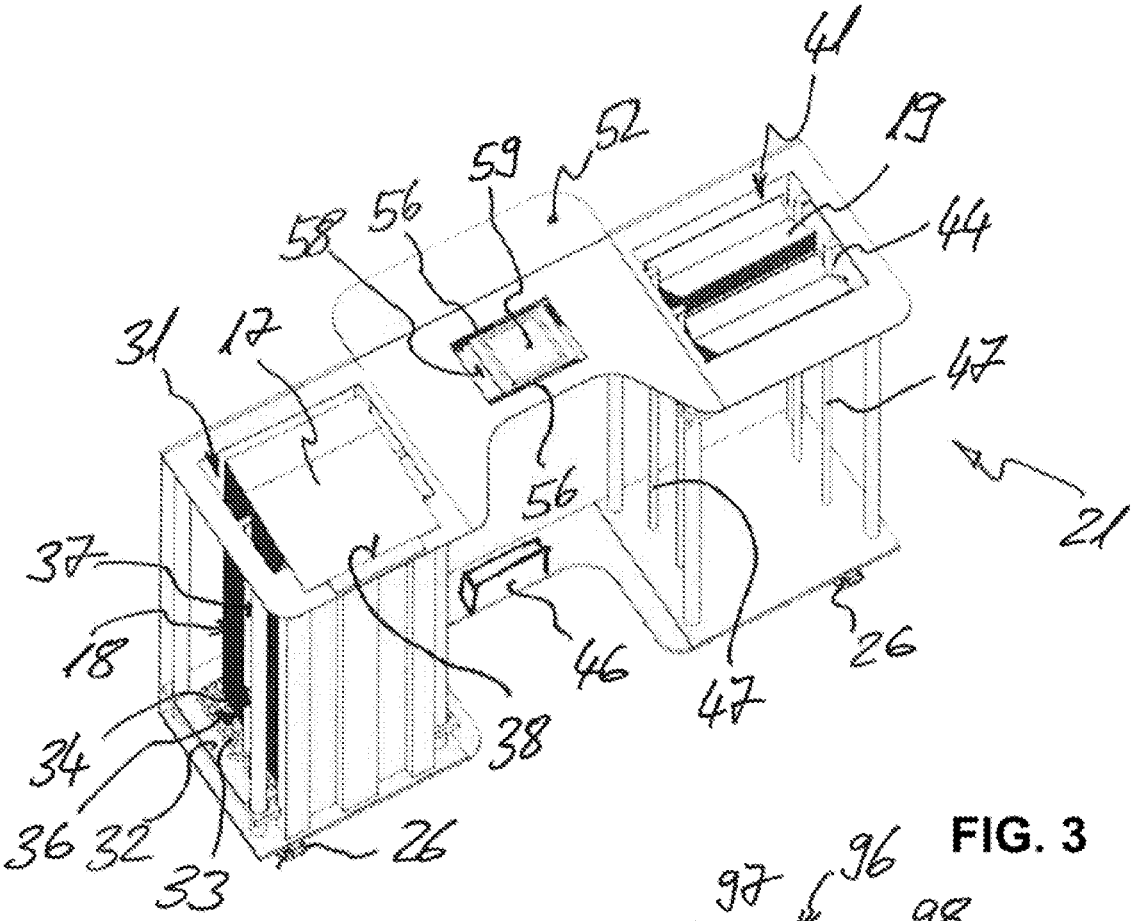
Figure 4:
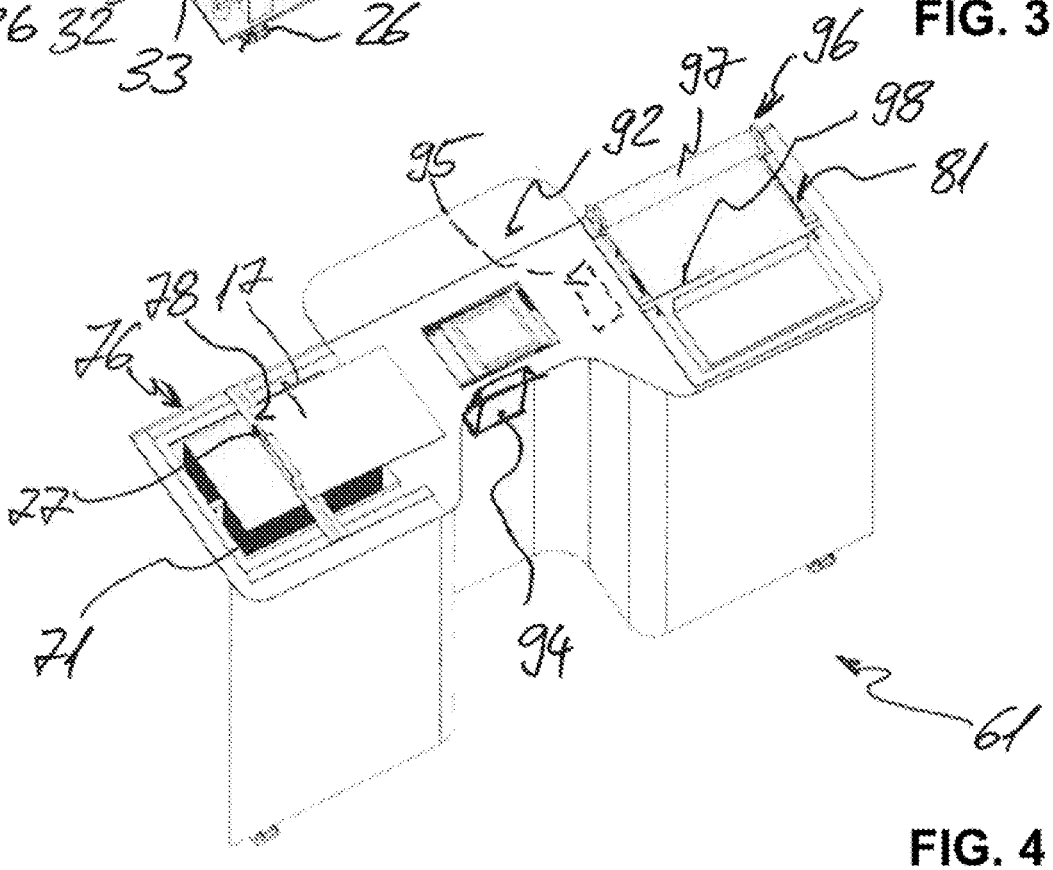
Figure 6:
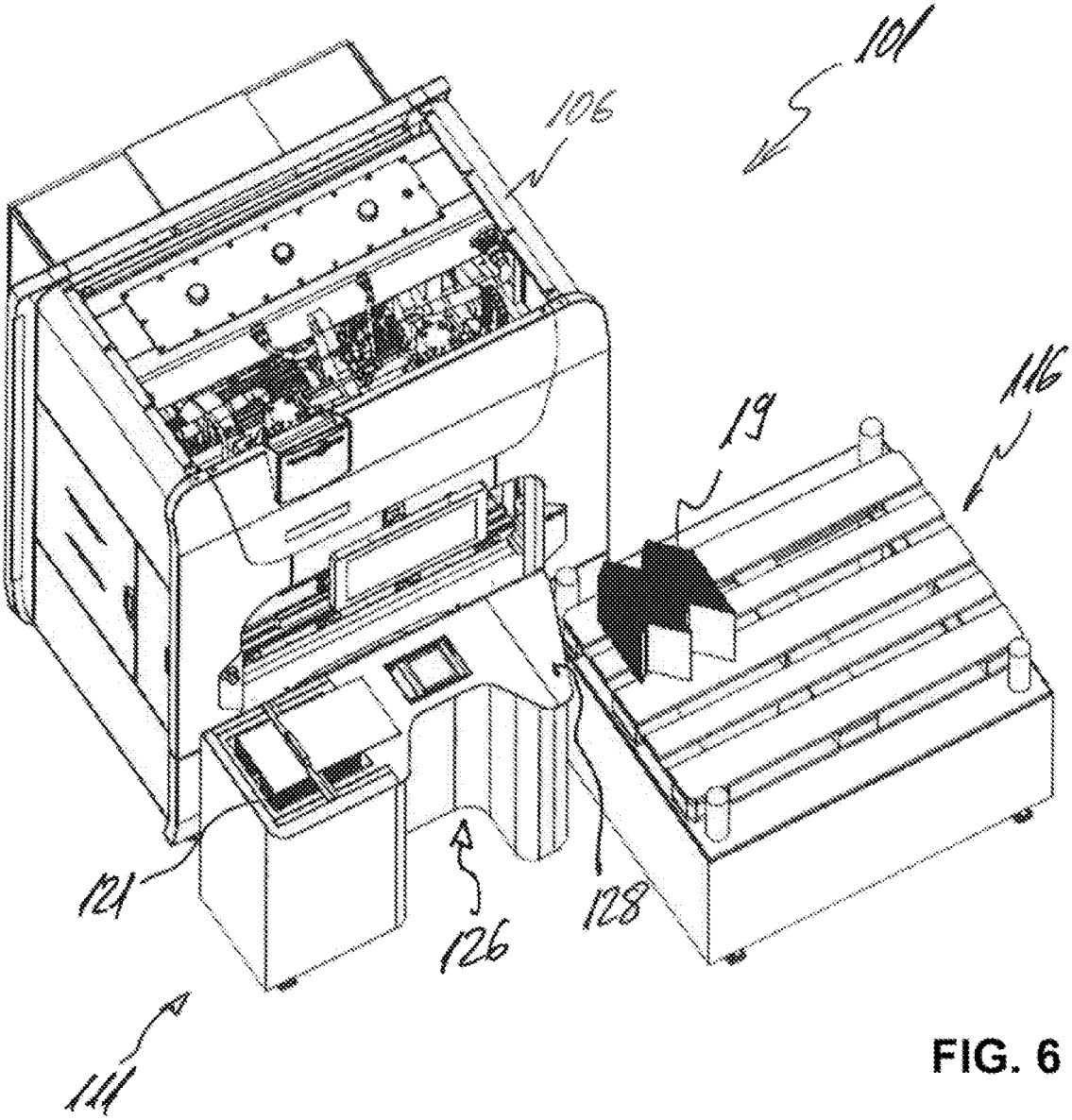
Figure 5:
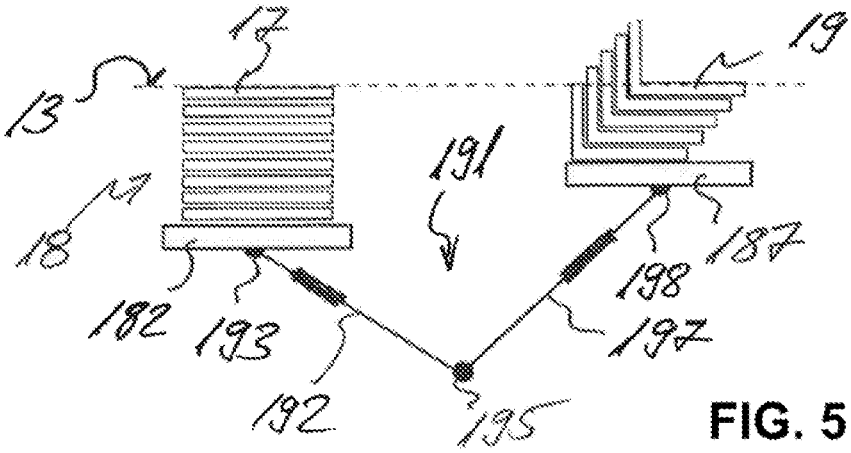
Figure 7:
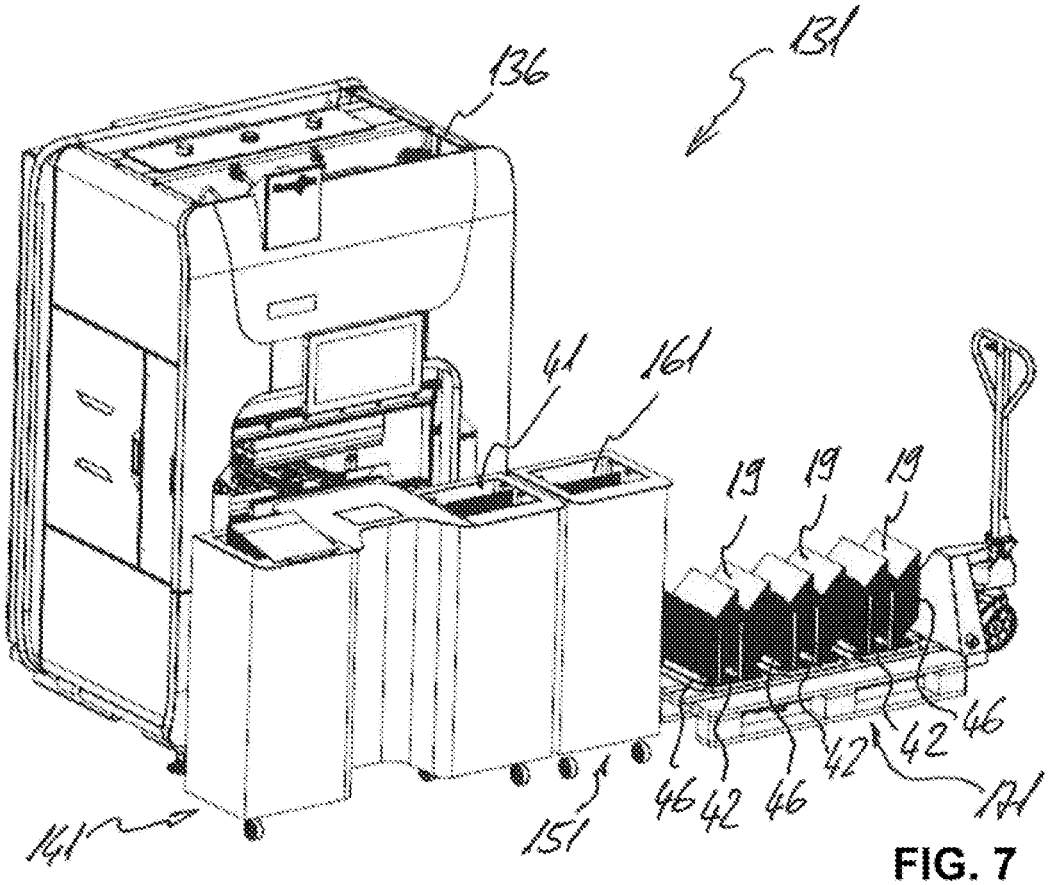
Figure 8:
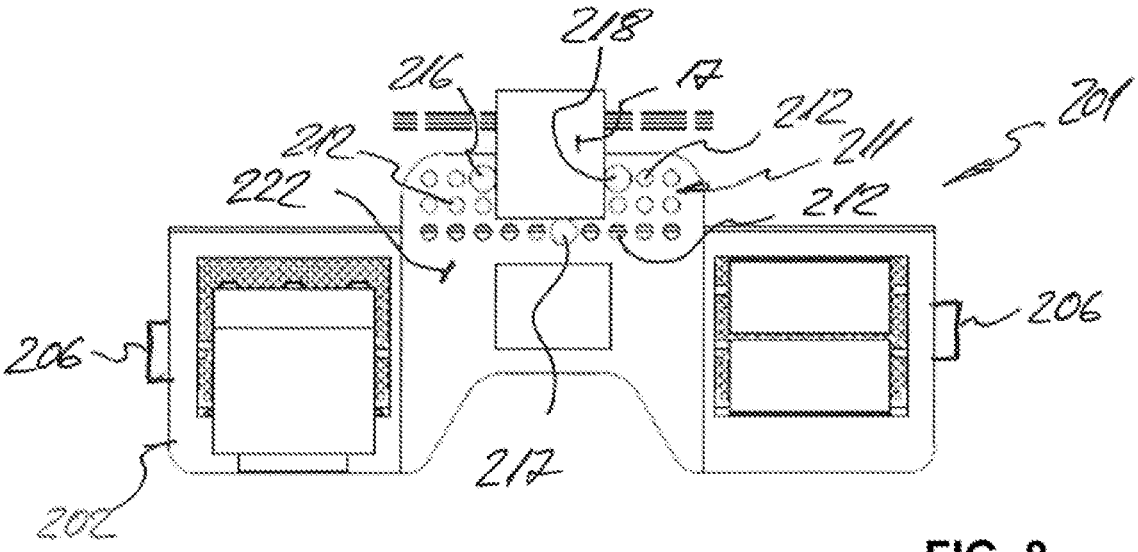
Figure 9:
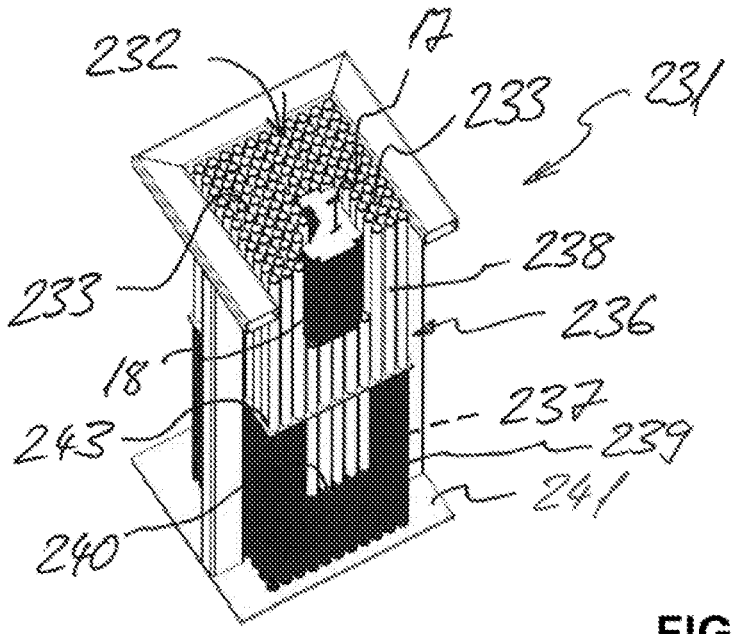
Figure 10:
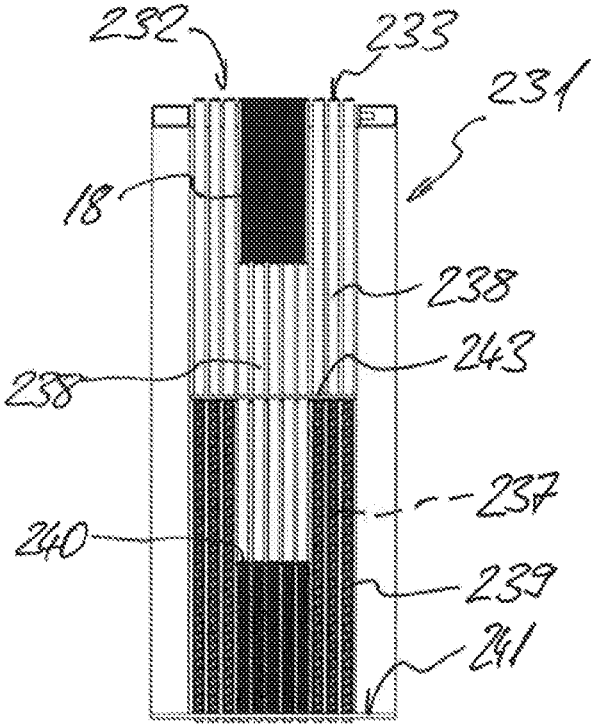
Figure 11:
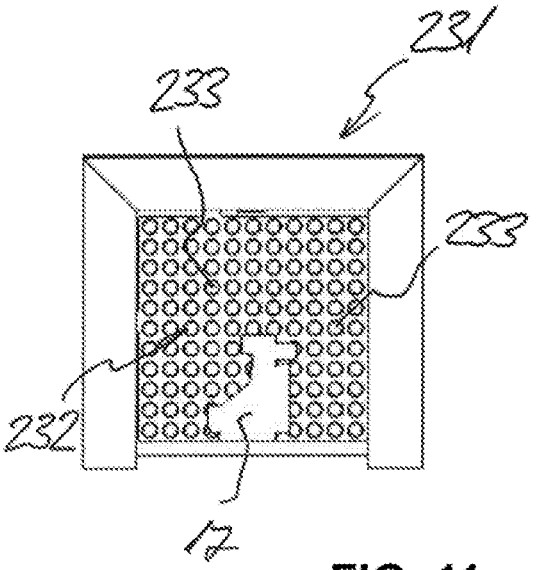
Figure 12:
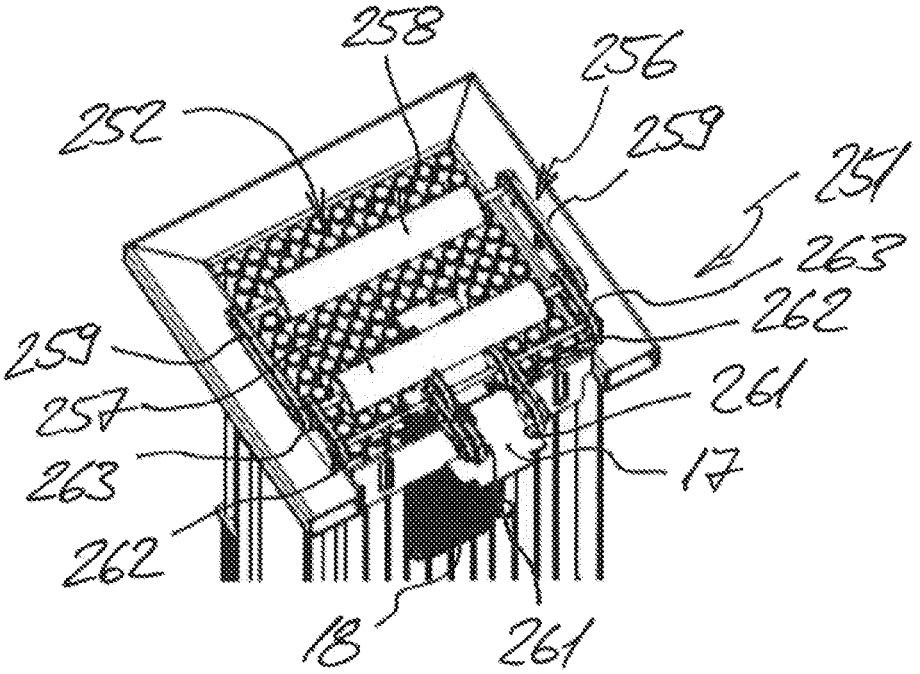
Figure 13:
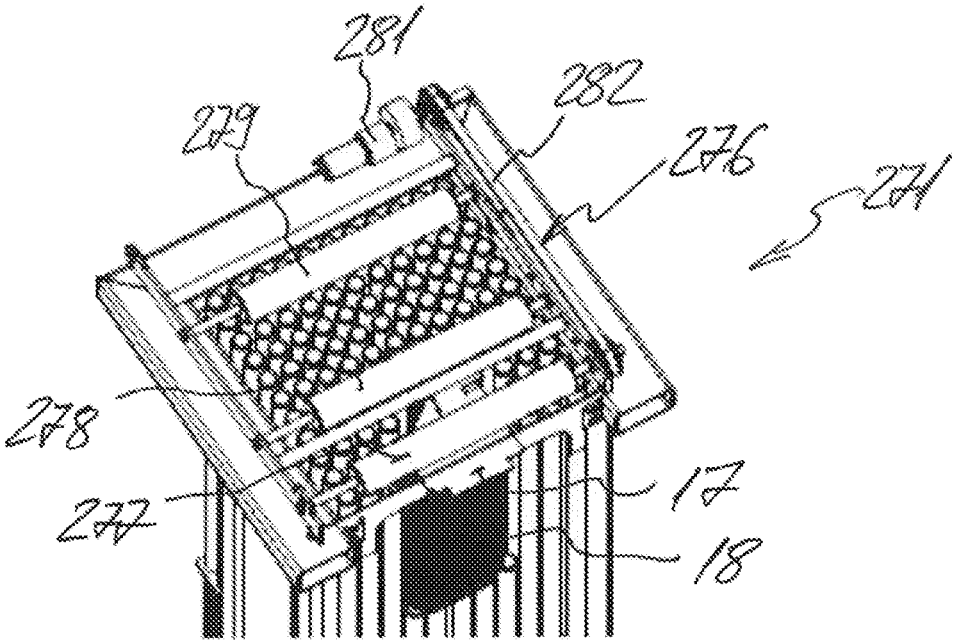
Figure 14:
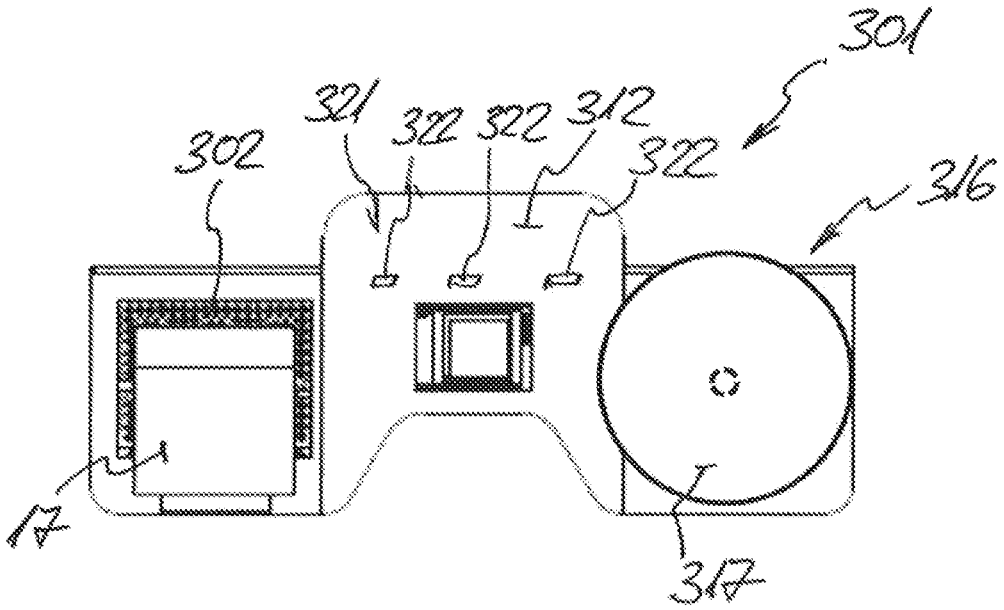
Figure 15:
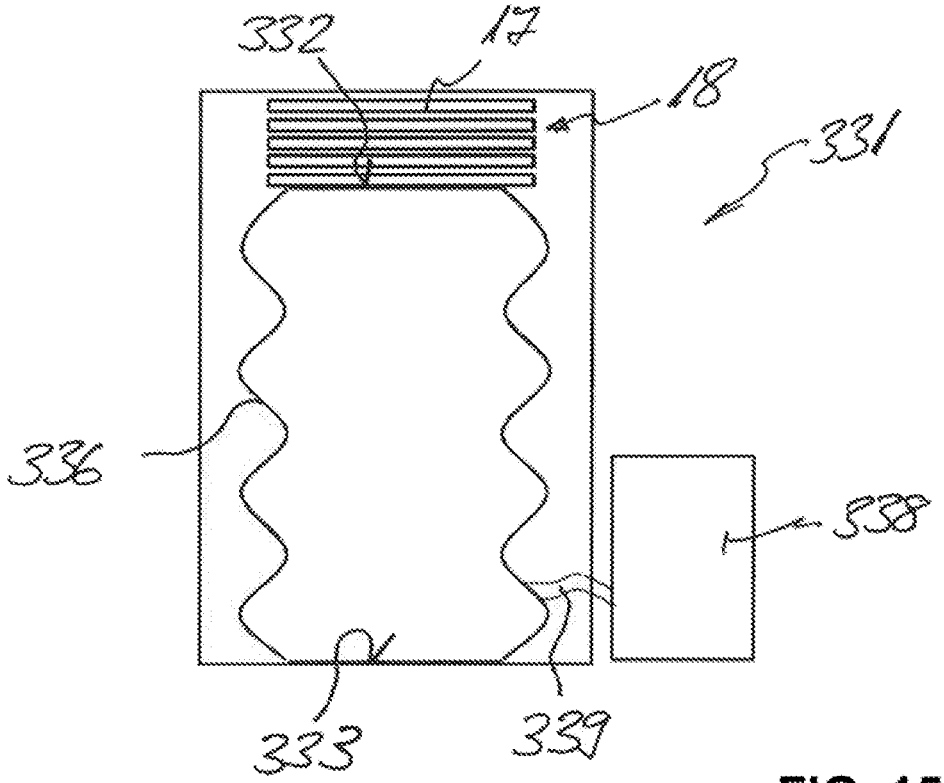

The figures show:

FIG. 1 a metal sheet processing device according to the invention in the form of a bending device with a bending press and a first embodiment of a metal sheet storage device according to the invention, in a perspectival view, FIG. 2 the metal sheet storage device according to FIG. 1, in a top view, FIG. 3 the metal sheet storage device according to FIG. 1 without housing, in a perspectival view, FIG. 4 a second embodiment of a metal sheet storage device according to the invention, in a perspectival view, FIG. 5 a schematic diagram of a principle of a repositioning device for a metal sheet storage device, FIG. 6 a third embodiment of a metal sheet storage device according to the invention with a bending press, in a perspectival view, FIG. 7 a fourth embodiment of a metal sheet storage device according to the invention with a bending press, in a perspectival view, FIG. 8 a fifth embodiment of a metal sheet storage device according to the invention, in a top view, FIG. 9 a variant of a support device, in a perspectival view, FIG. 10 the support device according to FIG. 9, in a side view, FIG. 11 the support device according to FIG. 9, in a top view, FIG. 12 a variant of a separation device, in a perspectival view, FIG. 13 another variant of a separation device, in a perspectival view, FIG. 14 a sixth embodiment of a metal sheet storage device according to the invention, in a top view, and FIG. 15 another variant of a separation device, in a side view.

The bending device 11 shown in FIG. 1 comprises, as a metal sheet processing device, a bending press 16 and a metal sheet storage device 21.

The metal sheet storage device 21 has a housing 22 with a housing upper face 23. On the bottom side of the metal sheet storage device 21, several rollers 26 are provided as a traversing unit, which allow for an easy repositioning of the metal sheet storage device 21. The metal sheet storage device 21 is, advantageously, detachably coupled to the bending press 16.

As can be seen, in particular, in FIGS. 2 and 3, the metal sheet storage device 21 has a first box-shaped space 31 (on the left side, based upon the drawings), which has dimensions appropriately adapted to the metal sheets 17 or bending parts to be processed. In the first space 31, a first support plate 32 for supporting a stack 18 of the metal sheets 17 or bending parts to be processed is provided as a first support device. The surface facing outwards (in this drawing, upwards) of the first support plate 32 forms its support plane 35. The first support plate 32 can be moved relative to the housing upper face 23 of the housing 22 of the metal sheet storage device 21, and vertically guided via a guide 37. A controllable machine axis is, furthermore, provided as adjusting device 34 for the first support plate 32, which adjusting device readjusts the first support plate 32, after each removal of a metal sheet 17, by the thickness of said metal sheet in the direction toward the housing upper face 23 of the housing 22 of the metal sheet storage device 21.

On the first support plate 32 or on its support plane 35, an attachment element 36 is provided, which is arranged on the first support plate 32 as needed. The first support plate 32 is provided in regions with a hole pattern 33, so that the attachment element 36 can be fixed on the first support plate 32 via corresponding plug connections. By means of this attachment element 36, the stack 18 of the metal sheets 17 or bending parts to be processed is inclined toward an operator, whereby the topmost metal sheet 17 of a stack 18 slides in the direction of the operator as soon as this metal sheet comes to rest outside the first box-shaped space 31. In order to limit the sliding of the topmost metal sheet 17, a stop surface 38 is provided.

The metal sheet storage device 21 has (on the right side, based upon the drawings) a second box-shaped space 41, which has dimensions appropriately adapted to the produced bending parts 19. In the second space 41, a second support plate 42 for supporting the produced bending parts 19 to be processed is provided as a second support device. The surface facing outwards (in this drawing, upwards) of the first support plate 42 forms its support plane 45. The second support plate 42 can also be moved relative to the housing upper face 23 of the housing 22 of the metal sheet storage device 21, and vertically guided via a guide 47. A spring arrangement is, furthermore, provided as adjusting device 44 for the second support plate 42, which spring arrangement repositions the second support plate 42 in the direction towards the housing upper face 23 of the housing 22 of the metal sheet storage device 21 in a spring-loaded manner. The spring force of this adjusting device 44 is adjusted such that, when a produced bending part 19 is placed onto the second support plate 42, the second support plate 42 is moved downwards (in this drawing) so that the operator can always deposit the produced bending parts 19 at the same working height.

The first support plate 32 and the second support plate 42 in the metal sheet storage device 21 can be moved separately from each other relative to the housing upper face 23 of the housing 22 of the metal sheet storage device 21.

The working height of the metal sheet storage device 21 can be adjusted, e.g., via the rollers 26, which can be moved, e.g., screwed in and out, for the adjustment. The metal sheet storage device 21 can thus be adapted to the operator for optimally ergonomic work.

The second support plate 42 or its support plane 45 is also provided with a hole pattern, region-wise, so that one or more attachment elements can also be fixed on it via appropriate plug connections. By means of these attachment elements, organized depositing or space-saving stacking of the produced bending parts 19 is ensured. Such an attachment element is, for example, designed as a negative form of the produced bending part.

Between the first space 31 and the second space 41, a work area section 51 is provided with a metal sheet storage device support plane 52. The metal sheet storage device support plane 52 is located in the same plane as the housing upper face 23 of the housing 22 of the metal sheet storage device 21. On the side facing the operator, an opening 54 for the operator is provided in the area of the work area section 51.

In the metal sheet storage device support plane 52, conveyors 56 for conveying the metal sheets 17 or metal sheet parts are, furthermore, provided, which conveyors in this case are designed as conveyor belts or rollers running in parallel. Via these conveyor belts or rollers, the operator can easily pull the metal sheet 17 or bending part removed from the first space 31, or the produced bending part 19, across the metal sheet storage device support plane 52. The conveyors 56 can also be driven, so that the metal sheet 17 or bending part or the produced bending part 19 is moved across the metal sheet storage device support plane 52 without any manual help from the operator.

The metal sheet storage device support plane 52 has, region-wise, a transparent region 58. Behind the transparent region 58, a display 59 for displaying information is provided.

In the region of the work area section 51, a power supply device 46 is, furthermore, provided for the metal sheet storage device 21. The power supply device 46 is, for example, designed as a rechargeable battery and, in particular, serves the power supply for the display 59 and/or the adjusting device 34 for the first support plate 32.

The metal sheet storage device 61 shown in FIG. 4 substantially differs from the previously shown metal sheet storage device 21 by a separation device 76 for separating the metal sheets 17 to be processed being provided in the first space 71. The separation device 76 comprises a slider 77, which can be operated manually and is guided laterally. Based upon the drawing, the operator first pulls the slider 77 all the way to the left and then pushes it back to the right, wherein the slider 77 comes to abut with a stop edge 78 against a lateral edge of the topmost metal sheet of the metal sheets 17 to be processed. In this case, the metal sheet 17 taken along is separated from the stack and moved onto the metal sheet storage device support plane 92.

The metal sheet storage device 61 furthermore has, above the second space 81, a post-processing device 96 for post-processing, in particular, the produced bending parts 19, but, where appropriate, also for the metal sheets 17. This post-processing device 96 comprises a film device with at least one roll of film 97. A film section can easily be cut to length using a length cutting device 98 designed as a knife. The film section cut to length is subsequently applied to the produced bending part 19, for example, in order to protect it against external influences and, in particular, damage, such as scratches.

In the region of the metal sheet storage device support plane 92, a printer is provided as another post-processing device 94, with which the metal sheet 17 or bending part to be processed, or the produced bending part 19, can be provided with a code, for example.

Further provided is a detection device 95 for a metal sheet 17 and/or a bending part to be processed or a produced bending part 19. The detection device 95 comprises, for example, a scanner, with which the current value of a metal sheet 17 and/or a bending part to be processed, or of a produced bending part 19, is detected and can be compared, for example, with a desired value.

If the detection device 95 also registers the quantity of the detected bending parts 19, a supply of the metal sheets 17 or bending parts to be processed can be ordered automatically, e.g., via a control of the metal sheet storage device 61 or a control of the bending press, before the quantity of metal sheets 17 or bending parts to be processed and available in the metal sheet storage device 61 is depleted. Alternatively, the quantity used of the metal sheets 17 or bending parts to be processed is determined via the weight of the respective parts detected in the first space 71 or in the second space 81.

The metal sheet processing device—in this case, the bending device 101 according to FIG. 6—comprises, as metal sheet processing machine, a bending press 106, a metal sheet storage device 111, and a storage unit 116 for the produced bending parts 19. The metal sheet storage device 111 largely corresponds to the metal sheet storage device 61 in terms of the design of the first space 121 and of the work area section 126, but a second space for receiving the produced bending parts 19 is not provided. These bending parts are stored temporarily on the storage unit 116. Adjacent to the work area section 126 is a transfer section 128 of the metal sheet storage device 111. Such a design is advantageous—for example, in case of large lot sizes or in case of bending parts 19 that occupy a large volume after production. This solution is, in particular, also particularly well-suited for bending parts that are bent several times and cannot be stacked into each other, for example.

As a further, but not exhaustive, example, FIG. 7 shows as metal sheet processing device a bending device 131 with a bending press 136 and a metal sheet storage device 141. The metal sheet storage device 141 is, on the one hand, designed like the previously described metal sheet storage device 21. However, in order to provide a larger accommodation space for the produced bending parts 19, another—in this case, separate—metal sheet storage device element 151 is provided, which has a second space 161, which is designed analogously to the second space 41 of the metal sheet storage device 21. Alternatively, the metal sheet storage device element 151 can be an integrated part of the metal sheet storage device 141.

As can also be seen in FIG. 7, each partial element of the metal sheet storage device 141 can also advantageously be designed as a separate work unit or as a separate work module, so that they can be combined into an individual metal sheet storage device by the operator as needed. If the operator requires a large metal sheet storage device support plane, for example, he arranges, to this end, two or more modules having such a metal sheet storage device support plane next to a module having at least one support device, or between two modules respectively having at least one support device. Such a modular metal sheet storage device can easily cover a plurality of work steps or work processes. In this case, the operator does not, however, always have to use a metal sheet storage device that is designed for each work step or work process and that therefore has large dimensions, as well as a corresponding weight. A modular metal sheet storage device can easily be handled by the operator.

In order to discharge the produced bending parts 19, a pallet lifting cart 171 is used, for example. For easy transport, the stacked, produced bending parts 19 are advantageously removed from the second space 41 or 161 together with the second support plate 42 and the attachment elements 46 arranged thereon. In order to continue to deposit produced bending parts, a new support plate 42 with, where appropriate, attachment elements 46 arranged thereon is inserted into the respective second space 41 or 161 after the removal.

FIG. 5 schematically shows the principle, when the first support plate 182 and the second support plate 187 are coupled to each other. The positions of the first support plate 182 and of the second support plate 186 are thus dependent upon each other. The weight of the metal sheets 17 or bending parts to be processed and the weight of the produced, i.e., bent, bending parts 19 remain constant. In this respect, an optimal and consistent working height 13 can still be realized via the lever principle in a coupled arrangement. A controlled drive, however, remains independent thereof, but is, however, not required.

The first arm 192 of the mechanical connection 191 is hinged to the first support plate 182 via a support plate rotary joint 193. The second arm 197 is hinged to the second support plate 187 via a support plate rotary joint 198. The first arm 192 and the second arm 197 can be swiveled via an arm rotary joint 195, whereby a constant weight adjustment and height adjustment of the two support plates 182 and 187 is given. The arm rotary joint 195 and/or the at least one of the support plate rotary joints 193 or 198 can be adjusted in order to optimize the system. The lengths of the first arm 192 and the second arm 197 can, moreover, be adjusted.

At the beginning of a production order, the first support plate 182 is in a lowest position, due to the high weight of the stack 18 of the metal sheets 17 or the bending parts to be processed. The first support plate 182 is positioned relative to the housing upper face 23 of the housing 22 such that the topmost metal sheet 17 or bending part to be processed comes to rest at the height of the work area, i.e., at the desired working height 13. The then still empty second support plate 187, on the other hand, is located in its highest position and, therefore, can also receive the produced bending parts 19 in an operator-friendly manner. As soon as the operator removes the highest of the metal sheets 17 or bending parts to be processed, processes it at the bending press, and deposits the produced bending part 19 on the second support plate 187, the second support plate 187 lowers, and the first support plate 182 rises accordingly. The next metal sheet 17 or bending part to be processed is thus again available to the operator at the desired working height 13.

The metal sheet storage device 201 shown in FIG. 8 corresponds in terms of its design to the previously described metal sheet storage device 21 or 141. In addition, on two opposite sides of the housing 202, one grip element each is provided as lifting device 206 for the metal sheet storage device 201. The forks of a forklift truck can engage in these grips, or conveyor belts can be arranged on these grips, for example, in order to easily reposition the metal sheet storage device 201 as needed.

This metal sheet storage device 201 furthermore has a metal sheet stop device 211 for stopping metal sheets 17 or bending parts 19. This metal sheet stop device 211 is provided in the region of the metal sheet storage device support plane 222, which faces the bending press.

The metal sheet stop device 211 has several fixing points 212 arranged in a pattern and designed as holes. The metal sheet stop device 211 furthermore has stop elements 216, 217, and 218, which are arranged on the fixing points 212 as needed, and in a manner adapted to the metal sheet 17 or the metal sheet part.

The support device 231 shown in FIGS. 9 through 11 has several rod-shaped support elements 236, all of which are arranged in parallel to each other on a base plate 241, and, respectively, have a free end. On the free end of each support element 236, a partial support surface 233 is provided. The partial support surfaces 233 of all support elements 236 together form the support plane 232 of the support device 231.

Each support element 236 is designed to be multi-part and has in this case two support element parts 237 and 238, which are designed to be tubular and are inserted into each other, and thus guided by each other. The first—in this case, lower—support element part 237 extends over a certain length, starting from the base plate 241, in the direction of the support plane 232 of the support device 231. The other second support element part 238 is pulled over the first support element part 238 and can be moved along the latter relatively to it in the manner of a telescope. On its free end, the second support element part 238 has the partial support surfaces 233, whereby the latter can be moved relative to each other.

In each support element 236, a spring element 239 is, furthermore, provided, which spring-loads the second support element part 238. The spring element 239 is a coil soling, which is pulled over the first support element part 237 and is thus easily supported by it. The spring element 239 is supported, with one end, on the base plate 241 and, with the other end, on the end of the second support element part 238, which is located opposite the free end of the second support element part 238. On this end of the second support element part 238, a section 240 that enlarges the outer dimensions is advantageously provided.

The second support element parts 238 are guided in a guide plate 243, which is arranged in an area between the base plate 241 and the support plane 232 to be movable, relative to the base plate 241. The guide plate 243 has appropriate openings for guiding the second support element parts 238. The enlarging section 240 of each second support element part 238 prevents said support element part from being pushed out of this guide plate 243 as a result of the load due to the spring element 239.

Moreover, this guide plate 243 forms an adjusting device for adjusting the support plane 232. The spring-loaded second support element parts 238 move in the unloaded state until their enlarging section 240 abuts against the guide plate 243. If the guide plate 243 is now moved relative to the base plate 241, the distance of the partial support surfaces 233 in relation to the base plate 241 changes accordingly.

On the other hand, the guide plate 243 constitutes an adjustment device for easily adjusting the spring force of the spring elements 239. If the guide plate 243 is moved relative to the base plate 241, the length of the spring elements 239, and thus their spring force, changes accordingly.

If a metal sheet 17 or a stack 18 is now deposited on the support plane 232, all second support element parts 238 loaded by this metal sheet 17 or by this stack 18 move in the direction of the base plate 241 as a result of the weight. In the process, the spring elements 239, which spring-load these second support element parts 238, are compressed. The topmost metal sheet 17 of a stack 18 is then advantageously located in the support plane 232. The unloaded support elements 236 or the unloaded support element parts 238 form a guide for the stack 18 or laterally support it, at least region-wise.

If the operator removes a metal sheet 17 from this stack 18, the weight-loading on the respective spring elements 239 decreases, whereupon the latter expand. In the process, the second support element parts 238, and thus also the stack 18, are moved in the direction of the support plane 232.

FIG. 12 shows a support device 251 with a semi-automatic separation device 256, which is arranged above the support plane 252. As a whole, the separation device 256 is advantageously arranged so as to swivel, whereby the metal sheet dispensing device can easily be filled.

The separation device 256 comprises a first roller 257 and a second roller 258, which are connected to each other via drive means 259, such as belts or toothed belts. At least one of the rollers 257 or 258—advantageously, both rollers 257 and 258—are designed as pressure rollers, which are spring-loaded in the direction of the support plane 252. Thus, an automatic adaptation of the system to changing metal sheet thicknesses is made possible, and the rollers 257 and/or 258 are in constant contact with the topmost metal sheet 17 of the stack 18.

At a removal point, where the operator can remove a metal sheet 17 from the support device 251, removal rollers 261 are provided, which, for their part, are connected to the first roller 257 via drive means 262 and 263, such as belts or toothed belts. The removal rollers 261 can, advantageously, be adjusted and, particularly advantageously, be moved at the removal point, e.g., along an axis, in order to adapt the latter to different contours of the metal sheets 17.

The rollers 257 and/or 258 and/or the removal rollers 261 are advantageously provided with as rough a surface as possible, in order to obtain an optimal coefficient of friction.

In order to remove a metal sheet 17, the operator reaches between the two removal rollers 261 and pulls out the metal sheet 17. Since the removal rollers 261 and also at least one of the rollers 257 or 258 are always in contact with the metal sheet 17, the translational motion of the metal sheet 17 during pulling is converted into a rotary motion of the removal rollers 261 and the rollers 257 and 258. Via the drive means 259, 262, and 263, the rotation of the removal rollers 261 also results in a rotation of the rollers 257 and 258, whereby the conveyance of the metal sheet 17 pulled by the operator is supported. In the process, the spring-loaded stack 18 is also moved in the direction of the separation device 256, which forms a stop. Now, the next metal sheet 17 is positioned for removal. This process can be repeated until the support device 251 or the respective metal sheet storage device is completely emptied.

FIG. 13 shows an automatic separation device 276 on a support device 271, wherein the automatic separation device 276 is also arranged so as to swivel. In this case, three rollers 277, 278, and 279 are provided, which are put into rotation by a motor 281, which drives a common drive means 282. The topmost metal sheet 17 is separated from the stack 18 in the process. A removal roller or a pressure roller, as described in case of the semiautomatic separation device 256, is not required. The rollers 277, 278, and 279 advantageously have as rough a surface as possible.

The motor 281 is an electric motor, for example, which is supplied with power by an integrated or external power supply, for example.

A sensor that monitors the position of the currently conveyed metal sheet 17 is advantageously attached near or adjacent to the removal point. The conveyance of the metal sheet 17 is, moreover, advantageously interrupted when the metal sheet 17 has been conveyed so far that it can be grabbed by the operator, but is still held. At this time point, the motor 281 is advantageously powered off, so that the rollers 277, 278, and 279 and the motor 281 can turn without damaging them when the metal sheet 17 is completely removed by the operator. As soon as the metal sheet 17 is completely removed, the process starts anew, and the next metal sheet 17 is provided for removal.

As shown in FIG. 14, the metal sheet storage device 301 has (on the left side, based upon the drawings) a support plane 302 of a support device for supporting a stack of the metal sheets 17 to be processed. The support plane 302 can be moved, and is vertically guided.

In contrast to the previously described metal sheet storage devices, this metal sheet storage device has (on the right side, based upon the drawings) a conveyor 316 designed as a rotary table 317 for conveying the metal sheets 17 or metal sheet parts.

Via this rotary table 317, the operator can easily feed or discharge metal sheets 17, or bending parts or produced bending parts. The rotary table 317 is advantageously driven in a motorized manner, e.g., electromotively, so that the metal sheet or bending part or the produced bending part arranged on the rotary table 317 is moved towards or away from the metal sheet storage device support plane 312 arranged between the support device and the conveyor 316.

On the metal sheet storage device support plane 312, several gas exit openings 322 are provided, from which a gas exits to create a gas store 321.

The support device 331 shown in FIG. 15 has a force device, which comprises a fluid-fillable container element 336. The fluid-fillable container element 336 is designed as a bellows cylinder. Compressed air can be applied to the fluid-fillable container element 336. The fluid-fillable container element 336 is supported on the base plate 333 of the support device 331 and has, on its opposite, free end, the support plane 332 of the support device 331. The stack 18 of the metal sheets 17 rests on this support plane 332.

In this case, a compressor 338 for generating compressed air is provided in a coordinated manner. Via the line 339 from the compressor 338 to the fluid-fillable container element 336, the latter can be pressurized using compressed air, and also depressurized as needed. Alternatively or supplementarily, a pressure relief valve can be provided on the fluid-fillable container element 336.

When loading the support device 331 with metal sheets 17 or metal sheet parts, the fluid-fillable container element 336 is, advantageously, unpressurized. After ending the loading process, for example, the fluid-fillable container element 336 is filled with compressed air by the compressor until the topmost metal sheet 17 of the stack 18 has reached the desired removal height.

When a metal sheet is removed, the fluid-fillable container element 336 expands as a consequence of the reduced weight-loading, such that the next metal sheet 17 again comes to rest at the same removal height.

Additional, non-exhaustive variants of the metal sheet storage device are mentioned below. The height of the entire metal sheet storage device, or at least of individual elements thereof, can preferably be adjusted, whereby the height can be adapted to changing working heights of the bending press, and an ergonomic working height is ensured. The height adjustment can be carried out by means of a manual device or via a controlled axis, for example.

When using particularly large metal sheets or bending parts to be processed, the individual elements of the metal sheet storage device can also be designed to be separate. The metal sheet feed device, the work area, and/or the finished part discharge device are respectively designed as separate partial devices that can advantageously be coupled to each other.

Such a solution is, in particular, advantageous if the ergonomics of the work area would otherwise be limited as a result of this size.

A lifting device—advantageously mounted in or near the work area—can also allow or facilitate the work—particularly with overly large metal sheets—of the operator.

The largest part of the features mentioned can be fully automated. In doing so, a robot can, for example, be used instead of or in addition to the operator.

The metal sheet storage device can easily be integrated into in-house processes, whereby processing times during production, and the required storage area, can be minimized.

For example, the mobility of the metal sheet storage device is simplified by forklift access or driverless transport.

The metal sheet storage device, furthermore, advantageously comprises means of communication, whereby the metal sheet storage device can communicate with other production sites of the company. For example, the metal sheet storage device transmits information that a supply of metal sheets is required in order for the production process to continue smoothly to a metal sheet providing device, such as a laser cutting machine or a water-jet machine, which thereupon produces the respective metal sheets as supply for the metal sheet storage device.

The metal sheet storage device can be coupled to a tool store (dies and templates) for the bending press, whereby product-specific tools can be precisely assigned to the respective bending plan, and transporting the tools away and storing them again after the end of the task are at the same time made possible.

The metal sheet storage device, advantageously, has a seat for the operator. This seat can advantageously be unfolded so that it only projects when needed and otherwise does not influence the work area of the operator. The seat is advantageously fixed in the folded stated by a holding device, e.g., a bolt, a magnet arrangement, or the like, so that is cannot unfold unintentionally. The height of the seat is, moreover, advantageously adjustable, whereby the seat can be adapted to the proportions of the operator.

List of reference symbols

| | | | |
|---|---|---|---|
| 11 | Bending device | 56 | Conveyor |
| 13 | Working height | 58 | Transparent region |
| 16 | Bending press | 59 | Display |
| 17 | Metal sheet | 61 | Metal sheet storage device |
| 18 | (Metal sheet) stack | 71 | First space |
| 19 | Produced bending part | 76 | Separation device |
| 21 | Metal sheet storage device | 77 | Slider |
| 22 | Housing | 81 | Second space |
| 23 | Housing upper face | 92 | Metal sheet storage device support plane |
| 26 | Rollers | 94 | Post-processing device (printer) |
| 31 | First space | 95 | Detection device |
| 33 | Hole pattern of 32 | 96 | Post-processing device |
| 32 | First support plate | 97 | Roll of film |
| 34 | Adjusting device of 32 | 98 | Length cutting device |
| 35 | Support plane | 101 | Bending device |
| 36 | Attachment element | 106 | Bending press |
| 37 | Guide for 32 | 111 | Metal sheet storage device |
| 38 | Stop surface | 116 | Storage unit |
| 41 | Second space | 121 | First space |
| 42 | Second support plate | 126 | Work area section |
| 44 | Adjusting device of 42 | 128 | Transfer section |
| 45 | Support plane | 216 | Stop element |
| 46 | Power supply device | 217 | Stop element |
| 47 | Guide for 42 | 218 | Stop element |
| 51 | Work area section | 222 | Metal sheet storage device support plane |
| 52 | Metal sheet storage device support plane | 231 | Support device |
| 54 | Opening | 232 | Support plane |
| 131 | Bending device | 233 | Partial support surface |
| 136 | Bending press | 236 | Support element |
| 141 | Metal sheet storage device | 237 | First support element part |
| 151 | Metal sheet storage device element | 238 | Second support element part |
| 161 | Second space | 239 | Spring element |
| 171 | Pallet lifting cart | 240 | Section of 238 |
| 182 | First support plate | 241 | Base plate |
| 187 | Second support plate | 243 | Guide plate |
| 191 | Mechanical connection | 251 | Support device |
| 192 | First arm | 252 | Support plane |
| 193 | Support plate rotary joint | 256 | Separation device |

-continued

| List of reference symbols | | | |
|---|---|---|---|
| 195 | Arm rotary joint | 257 | First roller |
| 197 | Second arm | 258 | Second roller |
| 198 | Support plate rotary joint | 259 | First drive means |
| 201 | Metal sheet storage device | 261 | Removal rollers |
| 202 | Housing | 262 | Second drive means |
| 206 | Lifting device | 263 | Third drive means |
| 211 | Metal sheet stop device | 331 | Support device |
| 212 | Fixing point | 332 | Support plane |
| 271 | Support device | 333 | Base plate |
| 276 | Separation device | 336 | Fluid-fillable container element |
| 277 | First roller | 338 | Compressor |
| 278 | Second roller | 339 | Line |
| 279 | Third roller | | |
| 281 | Motor | | |
| 282 | Drive means | | |
| 301 | Metal sheet storage device | | |
| 302 | Support plane | | |
| 312 | Metal sheet storage device support plane | | |
| 316 | Conveyor | | |
| 317 | Rotary table | | |
| 321 | Gas store | | |
| 322 | Gas exit opening | | |

The invention claimed is:

1. A metal sheet storage device comprising:

a housing, wherein the housing includes a housing upper face; and at least one support device within the housing for supporting metal sheets or bending parts, wherein the at least one support device includes at least one support plane, wherein at least the at least one support plane is configured to be moved relative to the housing upper face, wherein the at least one support device comprises several support elements, wherein partial support surfaces are provided on free ends of the support elements, wherein the partial support surfaces together form the at least one support plane of the at least one support device and are configured to be vertically moved relative to each other, wherein a guide is configured to guide vertical movement of the several support elements and be vertically displaced to adjust a biasing force associated with the several support elements without the several support elements supporting the metal sheets or bending part.

2. The metal sheet storage device according to claim 1, further comprising at least one adjusting device for adjusting the at least one support device and/or the at least one support plane.

3. The metal sheet storage device according to claim 1, wherein the several support elements are rod-shaped and/or are arranged in parallel to each other.

4. The metal sheet storage device according to claim 3, wherein at least a portion of the several support elements are respectively designed to be multi-part.

5. The metal sheet storage device according claim 1, wherein the at least one support device comprises at least one support plate, wherein the at least one support plane is formed by at least one of the surfaces of the at least one support plate.

6. The metal sheet storage device according to claim 1, wherein a force is applied to the at least one support device and/or at least one part thereof by means of at least one force device, wherein the force of the at least one force device is configured to be adjusted, wherein the at least one force device comprises at least one spring element and/or at least one fluid-fillable container element.

7. The metal sheet storage device according to claim 1, further comprising at least one attachment element, wherein the at least one attachment element is configured to be arranged as needed at or on the at least one support device.

8. The metal sheet storage device according to claim 1, further comprising at least one separation device for separating the metal sheets and/or the bending parts, wherein the separation device is arranged so as to swing out of the way.

9. The metal sheet storage device according to claim 1, further comprising a work area section with a metal sheet storage device support plane, wherein the metal sheet storage device support plane of the work area section is located in the same plane as the housing upper face of the housing of the metal sheet storage device.

10. The metal sheet storage device according to claim 9, further comprising at least one conveyor for conveying the metal sheets and/or the bending parts, wherein the at least one conveyor is provided in, on, or near the metal sheet storage device support plane, wherein the at least one conveyor comprises a rotary table.

11. The metal sheet storage device according to claim 9, wherein the metal sheet storage device support plane includes a transparent region.

12. The metal sheet storage device according to claim 9, further comprising a display for displaying information.

13. The metal sheet storage device according to claim 1, wherein at least one opening for the operator is provided on the metal sheet storage device.

14. The metal sheet storage device according to claim 1, further comprising at least one post-processing device for post-processing the metal sheets and/or the bending parts.

15. The metal sheet storage device according to claim 1, further comprising one first support device for supporting metal sheets or bending parts and at least one second support device for supporting metal sheets or bending parts, wherein the at least one support plane of the first support device and the at least one support plane of the at least one second support device are configured to be respectively moved relative to the housing upper face of the housing of the metal sheet storage device.

16. The metal sheet storage device according to claim 15, wherein the at least one support plane of the first support device and the at least one support plane of the at least one second support device are configured to be moved separately from each other relative to the housing upper face of the housing of the metal sheet storage device.

17. The metal sheet storage device according to claim 15, wherein the at least one support plane of the first support device and the at least one support plane of the at least one second support device are coupled to each other and are configured to be moved in opposite directions relative to the housing upper face of the housing of the metal sheet storage device.

18. The metal sheet storage device according to claim 1, further comprising at least one power supply device.

19. The metal sheet storage device according to claim 1, further comprising at least one detection device for a metal sheet and/or a bending part.

20. The metal sheet storage device according to claim 1, wherein a working height of at least a part of the metal sheet storage device is configured to be adjusted.

21. The metal sheet storage device according to claim 1, wherein at least one traversing unit is provided for the metal sheet storage device.

22. The metal sheet storage device according to claim 1, further comprising at least one lifting device for the metal sheet storage device.

23. The sheet storage device according to claim 1, further comprising at least one metal sheet stop device for stopping metal sheets or bending parts, wherein the at least one metal sheet stop device is provided in an area of the metal sheet storage device support plane.

24. The metal sheet storage device according to claim 23, wherein the at least one stop device includes several fixing points and at least one stop element configured to be arranged in at least one of the fixing points.

25. The metal sheet processing device according to claim 1, further comprising a metal sheet processing machine or a bending press.

* * * * *